US011192151B2

(12) United States Patent
Tomita et al.

(10) Patent No.: US 11,192,151 B2
(45) Date of Patent: Dec. 7, 2021

(54) CLEANING DEVICE, PLATING DEVICE INCLUDING THE SAME, AND CLEANING METHOD

(71) Applicant: EBARA CORPORATION, Tokyo (JP)

(72) Inventors: Masaki Tomita, Tokyo (JP); Shao Hua Chang, Tokyo (JP)

(73) Assignee: EBARA CORPORATION, Tokyo (JP)

( * ) Notice: Subject to any disclaimer, the term of this patent is extended or adjusted under 35 U.S.C. 154(b) by 135 days.

(21) Appl. No.: 16/590,769

(22) Filed: Oct. 2, 2019

(65) Prior Publication Data

US 2020/0108423 A1 Apr. 9, 2020

(30) Foreign Application Priority Data

Oct. 5, 2018 (JP) ..... JP2018-190133

(51) Int. Cl.

| | |
|---|---|
| ***B08B 3/02*** | (2006.01) |
| ***B08B 3/10*** | (2006.01) |
| ***C25D 21/12*** | (2006.01) |
| ***C25D 17/06*** | (2006.01) |

(52) U.S. Cl.

CPC ..... *B08B 3/10* (2013.01); *B08B 3/02* (2013.01); *C25D 17/06* (2013.01); *C25D 21/12* (2013.01)

(58) Field of Classification Search

CPC combination set(s) only.
See application file for complete search history.

(56) References Cited

U.S. PATENT DOCUMENTS

| | | | | |
|---|---|---|---|---|
| 2014/0020720 | A1* | 1/2014 | Fujikata | C25D 17/06 134/34 |
| 2014/0314957 | A1* | 10/2014 | Minami | B08B 3/047 427/352 |
| 2014/0318977 | A1 | 10/2014 | Moore et al. | |
| 2018/0282892 | A1* | 10/2018 | Fujikata | C23C 18/54 |

FOREIGN PATENT DOCUMENTS

| | | | | |
|---|---|---|---|---|
| JP | 2004183042 | * | 7/2001 | C25D 21/08 |
| JP | 2001234399 | * | 8/2001 | B08B 3/02 |
| JP | 2008-045179 | A | 2/2008 | |
| JP | 2013-083242 | A | 5/2013 | |

OTHER PUBLICATIONS

Machine translation of JP2001234399 (Year: 2001).*
Machine translation ofJP2004183042 (Year: 2004).*

* cited by examiner

*Primary Examiner* — Erin F Bergner
(74) *Attorney, Agent, or Firm* — BakerHostetler

(57) ABSTRACT

There is provided a cleaning device that cleans a substrate holder including a first holding member and a second holding member having an opening for exposing a substrate. This cleaning device includes a cleaning bath configured to house the substrate holder, an actuator configured to separate the second holding member from the first holding member, and a cleaning nozzle configured to discharge a cleaning liquid to the substrate holder housed in the cleaning bath. The cleaning nozzle is configured to pass through the opening of the second holding member.

16 Claims, 19 Drawing Sheets

CLEANING DEVICE, PLATING DEVICE INCLUDING THE SAME, AND CLEANING METHOD

TECHNICAL FIELD

Cross-Reference to Related Application

This application is based upon and claims benefit of priority from Japanese Patent Application No. 2018-190133 filed on Oct. 5, 2018, the entire contents of which are incorporated herein by reference.

The present invention relates to a cleaning device, a plating device including the same, and a cleaning method.

BACKGROUND ART

Conventionally, a device that performs electrolytic plating by inserting a substrate held onto a substrate holder into a plating bath storing a plating solution in a vertical direction has been known (for example, see PTL 1). A device that performs the electrolytic plating by turning a substrate held onto a substrate holder in a horizontal direction has been also known (for example, see PTL 2). The substrate holder used in such a plating device includes a seal ring holder including a seal that seals a surface of a substrate, and a baseplate. The substrate holder seals the surface of the substrate to form a space into which the plating solution does not get. The substrate holder has an electric contact that contacts the surface of the substrate to apply a current to the substrate in this space.

In such a substrate holder, appropriately sealing the surface of the substrate avoids the plating solution from getting into the above-described space. However, the plating solution infrequently gets into the above-described space due to, for example, an abnormality of the seal. When the plating solution gets into the above-described space, the plating solution contacts the electric contact to possibly cause the electric contact to corrode. In view of this, when what is called a leakage occurs on the substrate holder to cause the plating solution to contact the electric contact, it is necessary to clean the electric contact. When the substrate holder is repeatedly used, a foreign matter may attach to the seal or the electric contact. In view of this, the seal and the electric contact of the substrate holder are preferably periodically cleaned. In this context, a cleaning device that cleans a sealing member and the like of a substrate holder has been known (see PTL 3).

CITATION LIST

Patent Literature

PTL 1: Japanese Unexamined Patent Application Publication No. 2013-83242

PTL 2: U.S. Unexamined Patent Application Publication No. 2014/0318977

PTL 3: Japanese Unexamined Patent Application Publication No. 2008-45179

SUMMARY OF INVENTION

Technical Problem

In the cleaning device as described above, to perform effective cleaning by spraying a cleaning liquid to the seal and the electric contact of the substrate holder, a nozzle is preferably arranged between the seal ring holder and the baseplate. However, when a mechanism that moves the nozzle to between the seal ring holder and the baseplate is employed, there is a problem that the cleaning device increases in size.

The present invention has been made in consideration of the above-described problems and one object of the present invention is to provide a cleaning device configured to arrange a nozzle between a seal ring holder and a baseplate of a substrate holder and reduce an increase in device size.

Solution to Problem

According to one aspect of the present invention, there is provided a cleaning device that cleans a substrate holder including a first holding member and a second holding member having an opening for exposing a substrate. This cleaning device includes a cleaning bath configured to house the substrate holder, an actuator configured to separate the second holding member from the first holding member, and a cleaning nozzle configured to discharge a cleaning liquid to the substrate holder housed in the cleaning bath. The cleaning nozzle is configured to pass through the opening of the second holding member.

According to another aspect of the present invention, a plating device is provided. This plating device includes the above-described cleaning device and a plating bath configured to house a plating solution.

According to another aspect of the present invention, there is provided a cleaning method for cleaning a substrate holder including a first holding member and a second holding member having an opening for exposing a substrate. This cleaning method includes housing the substrate holder in a cleaning bath, separating the second holding member from the first holding member, passing a cleaning nozzle through the opening, and discharging a cleaning liquid to the substrate holder from the cleaning nozzle in a state where the cleaning nozzle is arranged between the first holding member and the second holding member.

DESCRIPTION OF EMBODIMENTS

Figure 1:
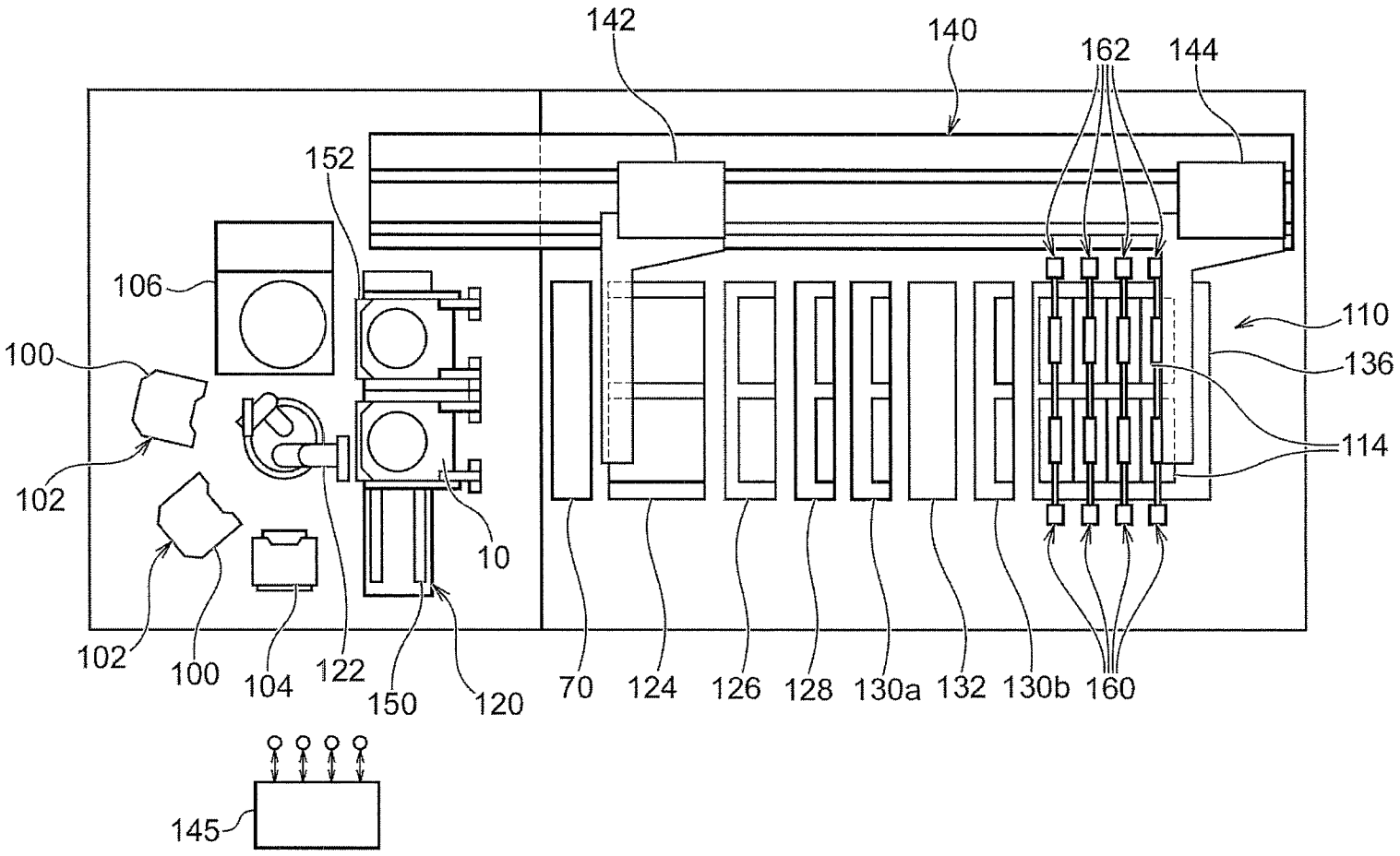
FIG. 1 is an entire layout drawing of a plating device according to an embodiment.

The following describes an embodiment of the present invention with reference to the drawings. In the drawings described later, the identical reference numerals are assigned for the identical or equivalent elements, and therefore such elements will not be further elaborated here. FIG. 1 is an entire layout drawing of a plating device according to the embodiment. As illustrated in FIG. 1, this plating device includes two cassette tables 102, an aligner 104, and a spin rinse dryer 106. The aligner 104 aligns positions of an orientation flat, a notch, and the like of a substrate in a predetermined direction. The spin rinse dryer 106 rotates the substrate after a plating process at high speed to dry it. The cassette table 102 includes a cassette 100 storing the substrate such as a semiconductor wafer. A substrate attaching and removing portion 120 on which a substrate holder 10 is placed to perform attaching and removing of the substrate is provided near the spin rinse dryer 106. In the center of these units 100, 104, 106, and 120, a substrate conveyance device 122 formed of a conveyance robot that conveys the substrate between these units is arranged.

The substrate attaching and removing portion 120 includes a tabular mounting plate 152 slidable in a lateral direction along a rail 150. The two substrate holders 10 are placed in parallel on this mounting plate 152 in a horizontal state, and delivery of the substrate is performed between one substrate holder 10 and the substrate conveyance device 122. Afterwards, the mounting plate 152 is slid in the lateral direction, and the delivery of the substrate is performed between the other substrate holder 10 and the substrate conveyance device 122.

The plating device further includes a cleaning device 70, a stocker 124, a preprocessing bath 126, a pre-soak bath 128, a first cleaning bath 130*a*, a blow bath 132, a second cleaning bath 130*b*, and a plating bath 110. The cleaning device 70, as described later, periodically cleans the substrate holder 10 and preferentially cleans the substrate holder 10 on which a leakage occurred. In the stocker 124, storing and temporarily placing of the substrate holder 10 are performed. In the preprocessing bath 126, a hydrophilic treatment is performed on the substrate. In the pre-soak bath 128, an oxide film on a surface of a conducting layer of a seed layer or the like formed on a surface of the substrate is removed by etching. In the first cleaning bath 130*a*, the substrate after the pre-soak is cleaned with a cleaning liquid (for example, a pure water) together with the substrate holder 10. In the blow bath 132, liquid draining of the substrate after the cleaning is performed. In the second cleaning bath 130*b*, the substrate after plating is cleaned with the cleaning liquid together with the substrate holder 10.

The plating bath 110 is, for example, configured to house a plurality of plating cells 114 inside an overflow bath 136. Each plating cell 114 is configured to internally house one substrate and perform the plating such as copper plating on the substrate surface by immersing the substrate in a plating solution that is internally held.

The plating device includes a substrate holder conveyance device 140 employing, for example, a linear motor system. The substrate holder conveyance device 140 is positioned at the side of these respective devices and conveys the substrate holder 10 together with the substrate between these respective devices. This substrate holder conveyance device 140 includes a first transporter 142 and a second transporter 144. The first transporter 142 is configured to convey the substrate between the substrate attaching and removing portion 120, the cleaning device 70, the stocker 124, the preprocessing bath 126, the pre-soak bath 128, the first cleaning bath 130*a*, and the blow bath 132. The second transporter 144 is configured to convey the substrate between the first cleaning bath 130*a*, the second cleaning bath 130*b*, the blow bath 132, and the plating bath 110. The plating device may include only the first transporter 142 without the second transporter 144.

Paddle driving portions 160 and paddle driven portions 162 are arranged on both sides of the overflow bath 136. The paddle driving portion 160 and the paddle driven portion 162 are positioned inside each plating cell 114 to drive a paddle as a stirring rod that stirs the plating solution in the plating cell 114.

The plating device includes a control unit 145 configured to control operation of the above-described respective portions of the plating device. The control unit 145 includes, for example, a computer readable recording medium storing a predetermined program to cause the plating device to execute a plating process, and a Central Processing Unit (CPU) that executes the program in the recording medium. The control unit 145 is configured to perform, for example, an operational control for the cleaning device 70, an attaching and removing operational control for the substrate attaching and removing portion 120, a conveyance control for the substrate conveyance device 122, a conveyance control for the substrate holder conveyance device 140, and a control of a plating current and a plating time in the plating bath 110. As the recording medium included in the control unit 145, any recording means including a magnetic medium such as a flexible disk, a hard disk, and a memory storage, an optical medium such as a CD and a DVD, and a magneto-optic medium such as an MO and an MD can be employed.

A description will be given of an exemplary sequence of plating process by this plating device. First, the substrate conveyance device 122 takes out one substrate from the cassette 100 mounted on the cassette table 102 to convey the substrate to the aligner 104. The aligner 104 aligns the positions of the orientation flat, the notch, and the like in the predetermined direction. The substrate conveyance device 122 conveys the substrate whose direction is aligned by this aligner 104 to the substrate attaching and removing portion 120.

In the substrate attaching and removing portion 120, the first transporter 142 of the substrate holder conveyance device 140 simultaneously grips the two substrate holders 10 housed in the stocker 124 to convey them to the substrate attaching and removing portion 120. Then, the two substrate holders 10 are simultaneously and horizontally placed on the mounting plate 152 of the substrate attaching and removing portion 120. In this state, the substrate conveyance device 122 conveys the substrates to the respective substrate holders 10 to cause the substrate holders 10 to hold the conveyed substrates.

After the substrates are mounted on the substrate holders 10, a leakage inspection device disposed on the substrate attaching and removing portion 120 inspects presence/absence of leakage on the substrate holders 10. When there is no leakage on the substrate holders 10, the first transporter 142 of the substrate holder conveyance device 140 simultaneously grips the two substrate holders 10 holding the substrates to convey them to the preprocessing bath 126. Next, the first transporter 142 conveys the substrate holders 10 holding the substrates processed in the preprocessing bath 126 to the pre-soak bath 128 to etch the oxide films on the substrates in the pre-soak bath 128. Subsequently, the substrate holders 10 holding these substrates are conveyed to the first cleaning bath 130*a* to clean the surfaces of the substrates with the pure water housed in this first cleaning bath 130*a*.

The second transporter 144 conveys the substrate holders 10 holding the substrates after the water cleaning from the first cleaning bath 130*a* to the plating bath 110 to house them in the plating cells 114 filled with the plating solution. The second transporter 144 sequentially and repeatedly performs the above-described procedure to sequentially house the substrate holders 10 holding the substrates in the respective plating cells 114 of the plating bath 110.

In each plating cell 114, a plating voltage is applied to between an anode (not illustrated) in the plating cell 114 and the substrate, and simultaneously the paddle driving portion 160 and the paddle driven portion 162 reciprocate the paddle parallel to the surface of the substrate to plate the surface of the substrate.

After the end of the plating, the second transporter 144 simultaneously grips the two substrate holders 10 holding the substrates after the plating, conveys them to the second cleaning bath 130*b*, and then, cleans the surfaces of the substrates with the pure water by immersing them in the pure water housed in the second cleaning bath 130*b*. Next, the second transporter 144 conveys the substrate holders 10 to the blow bath 132 to remove water droplets attached to the substrate holders 10 by, for example, spraying air. Afterwards, the first transporter 142 conveys the substrate holders 10 to the substrate attaching and removing portion 120.

In the substrate attaching and removing portion 120, the substrate conveyance device 122 takes out the substrate after the process from the substrate holder 10 to convey it to the spin rinse dryer 106. The spin rinse dryer 106 rotates the substrate after the plating process at high speed to dry it. The substrate conveyance device 122 returns the dried substrate to the cassette 100. When the substrate is removed from the substrate holder 10, the leakage inspection device disposed on the substrate attaching and removing portion 120 inspects whether the leakage occurs inside the substrate holder 10 or not.

Figure 2:
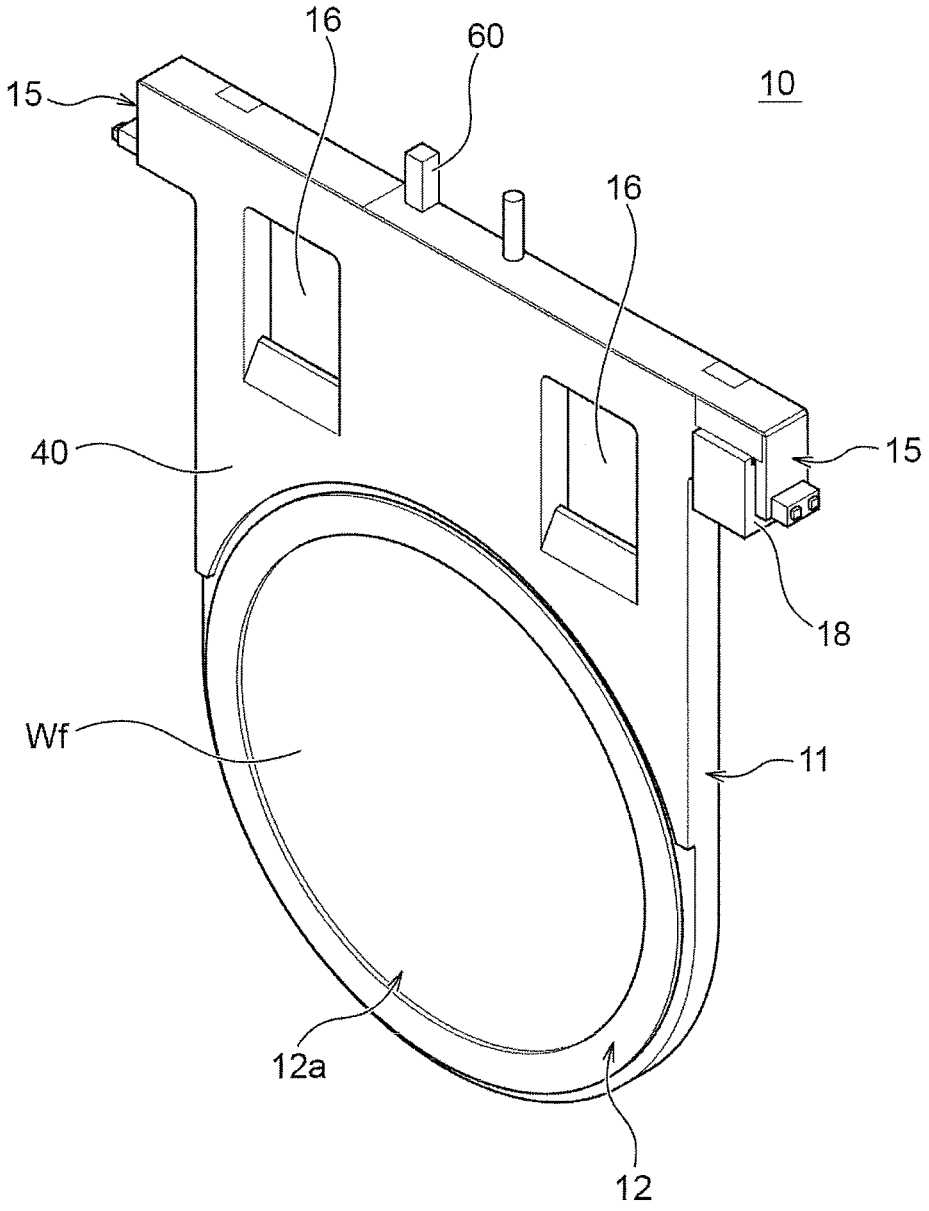
FIG. 2 is a perspective view of a substrate holder.

The following describes the substrate holder 10 used in the plating device according to the embodiment. FIG. 2 is a perspective view of the substrate holder 10. As illustrated in FIG. 2, the substrate holder 10 includes a tabular first holding member 11 and a second holding member 12 configured to sandwich the substrate together with this first holding member 11. The first holding member 11 has a body 40 made of, for example, Polytetrafluoroethylene (PTFE). The body 40 plays a role of a chassis that constitutes an outer surface of the first holding member 11. The first holding member 11 of the substrate holder 10 has approximately center portion on which a substrate Wf is placed. The second holding member 12 has an opening 12*a* that exposes the substrate Wf. The second holding member 12 is entirely formed into an approximately ring shape.

The first holding member 11 of the substrate holder 10 has end portions to which a pair of hands 15 as supporting portions when the substrate holder 10 is suspended on the plating bath 110 or the like are coupled. In the bath such as the stocker 124 illustrated in FIG. 1, the substrate holder 10 is perpendicularly suspended and supported by hooking the hands 15 on an upper surface of a peripheral wall of the bath. The first holding member 11 has a pair of openings 16 with which the substrate holder conveyance device 140 grips the substrate holder 10 when conveying it.

One of the hands 15 includes an outer contact portion 18 electrically connected to an external power supply (not illustrated). This outer contact portion 18 is electrically connected to a baseplate 42 and a hook ring 45, which are described later (see FIG. 3). The outer contact portion 18 contacts a power feeding terminal disposed on a side of the plating bath 110 when the substrate holder 10 is suspended on and supported to the plating bath 110. FIG. 2 illustrates a part of a rod member 60 which is described later.

Figure 3:
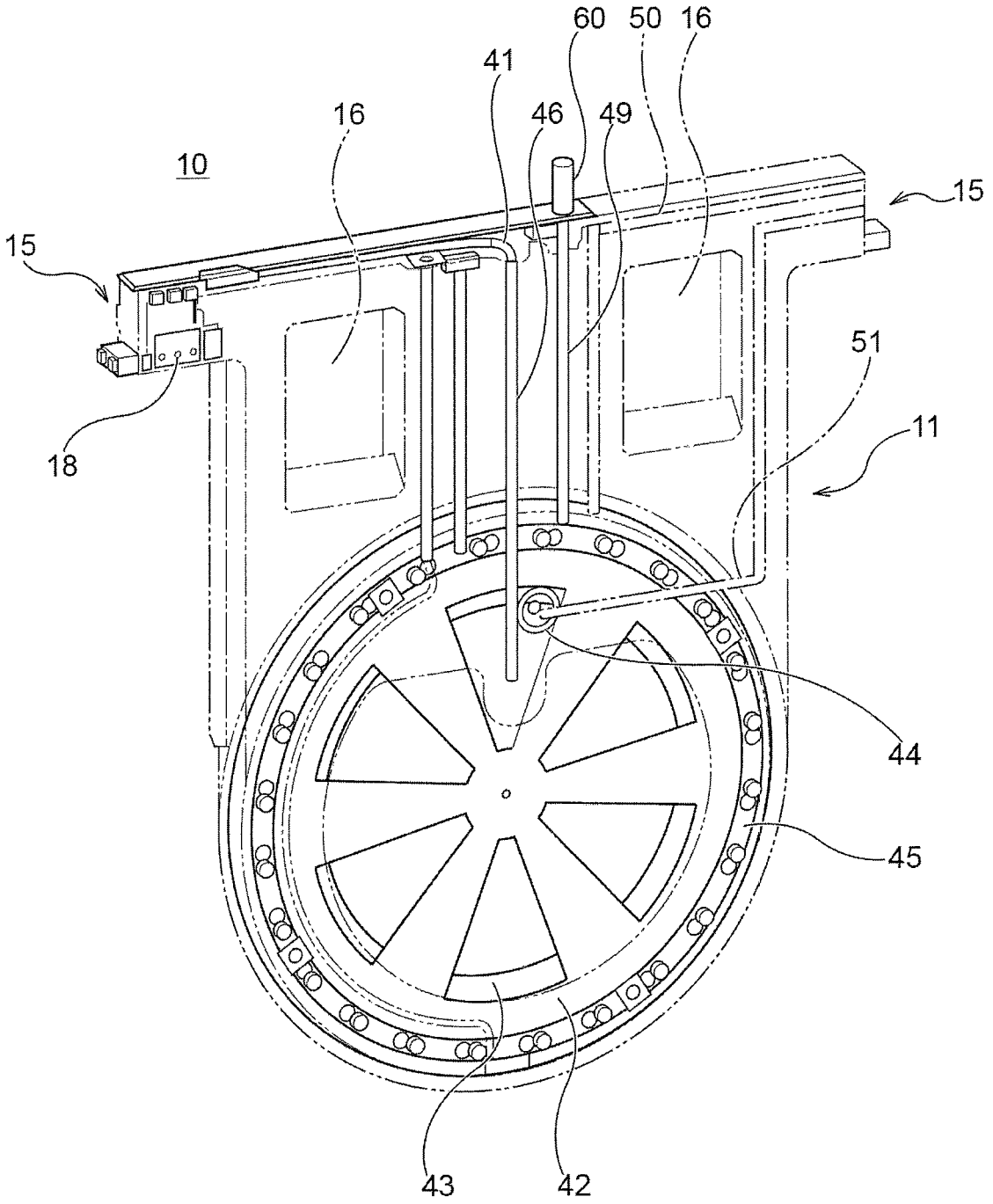
FIG. 3 is a perspective view on a back surface side of the substrate holder.

FIG. 3 is a perspective view on a back surface side of the substrate holder 10. In FIG. 3, the body 40 of the first holding member 11 is illustrated transparent. As illustrated in FIG. 3, the first holding member 11 includes a busbar 41, the baseplate 42, a substrate mounting table 43, a suction pad 44, and the hook ring 45.

The busbar 41 is configured to electrically connect the outer contact portion 18 to the baseplate 42. The busbar 41 is arranged on a busbar inner passage 46 formed on the first holding member 11. A seal (not illustrated) seals between the busbar 41 and a wall surface that defines the busbar inner passage 46. This seals the busbar inner passage 46 to avoid liquid intrusion into an internal space of the substrate holder 10 and ensures an air tightness in the internal space of the substrate holder 10.

The baseplate 42 is a circular plate formed of a conductive body such as an SUS. The baseplate 42 has a plurality of approximately circular sector openings along a circumferential direction and has a center portion electrically connected to the busbar 41. The baseplate 42 is configured to radially apply the current supplied from the busbar 41 toward an outer periphery of the baseplate 42 to supply the hook ring 45 with the current. The substrate mounting table 43 is configured movable with respect to the body 40 and the baseplate 42 and biased toward the second holding member 12 from the baseplate 42 by a spring 56 as described later.

The suction pad 44 is disposed on a surface of the substrate mounting table 43 and configured to suction a back surface of the substrate Wf arranged on the substrate mounting table 43. The hook ring 45 is disposed between the body 40 and the baseplate 42 and configured to fix the second holding member 12 to the first holding member 11 in a way that a hook pin 26 (see, for example, FIG. 5A to FIG. 5C)

is engaged with the hook ring 45 as described later. The hook ring 45 is formed of a conductive body such as the SUS and configured to apply the current supplied from the baseplate 42 to the hook pin 26. The suction pad illustrated in the drawing has an approximately circular suction cup shape but not limited to this. The suction pad may have an approximately annular shape extending in the circumferential direction.

The first holding member 11 further, internally includes a rod inner passage 49, a leakage check line 50, and a substrate suction vacuum line 51. The leakage check line 50 is a passage that communicates the internal space of the substrate holder 10 with an outside of the substrate holder 10 via a leakage check hole 67 (see FIG. 7) which is described later. The substrate suction vacuum line 51 is a passage that communicates the suction pad 44 with the outside. In this description, the internal space of the substrate holder 10 means a sealed space inside the substrate holder 10, which is formed of a substrate-side sealing member 21 and a holder-side sealing member 22 (see FIG. 4), which are described later, of the second holding member 12.

Figure 4:
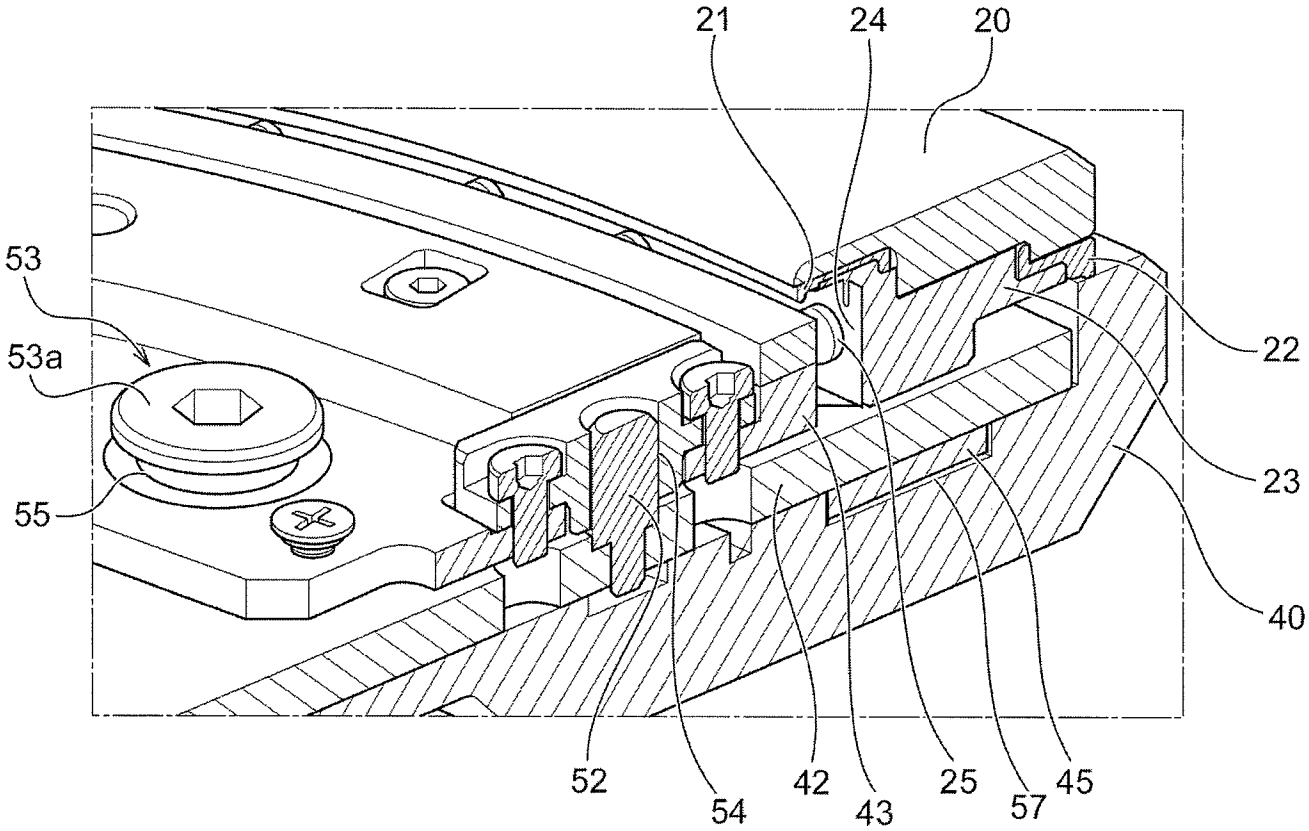
FIG. 4 is a partial cross-sectional perspective view of the substrate holder.

FIG. 4 is a partial cross-sectional perspective view of the substrate holder 10. In an example illustrated in the drawing, the substrate Wf is omitted. As illustrated in FIG. 4, the second holding member 12 includes a seal ring holder 20, the substrate-side sealing member 21, the holder-side sealing member 22, an inner ring 23, and contacts 24. The seal ring holder 20 is an approximately plate-shaped ring. The seal ring holder 20, which is a member exposed when the second holding member 12 is mounted on the first holding member 11, is made of, for example, polyether ether ketone (PEEK) from the aspect of resistance to plating solution.

The inner ring 23 is a ring-shaped member mounted on the seal ring holder 20 of the second holding member 12 with a fixing member (not illustrated). The inner ring 23 has a radially inside surface to which a plurality of contacts 24 are fixed with screws 25. The inner ring 23 is formed of a conductive body such as the SUS for electrical conduction to the contacts 24. The plurality of contacts 24 are configured to contact the substrate Wf along a periphery portion of the substrate Wf when the second holding member 12 is mounted on the first holding member 11.

The substrate-side sealing member 21 is configured to contact the substrate Wf along the periphery portion of the substrate Wf when the second holding member 12 is mounted on the first holding member 11. The holder-side sealing member 22 is configured to contact the body 40 of the first holding member 11 when the second holding member 12 is mounted on the first holding member 11. The substrate-side sealing member 21 and the holder-side sealing member 22 are both formed into approximately ring shapes and are closely fixed to an inner peripheral side and an outer peripheral side of the seal ring holder 20 respectively by being sandwiched by the seal ring holder 20 and the inner ring 23. The substrate-side sealing member 21 and the holder-side sealing member 22 contact the substrate Wf and the body 40 respectively to form the sealed space (the internal space) inside the substrate holder 10.

The first holding member 11 includes a guide shaft 52 and a stopper 53 as illustrated in the drawing. The substrate mounting table 43 has a through-hole 54 through which the guide shaft 52 passes and a through-hole 55 through which the stopper 53 passes. The guide shaft 52 and the stopper 53 each have one end fixed to the baseplate 42 and extend inside the through-hole 54 and the through-hole 55 approximately parallel to a normal direction of the substrate Wf respectively. The stopper 53 includes a flange portion 53*a* on an end portion on a side opposite to the end portion fixed to the baseplate 42. The substrate mounting table 43 is biased toward the second holding member 12 from the body 40 and the baseplate 42 by the spring 56 described later. The substrate mounting table 43 is guided approximately parallel to the normal direction of the substrate Wf by the guide shaft 52. The substrate mounting table 43 contacts the flange portion 53*a* of the stopper 53 when being biased by the spring 56 described later, and thus, movement of the substrate mounting table 43 is restricted.

The body 40 of the first holding member 11 has an annular groove 57 for housing the hook ring 45. The hook ring 45 is configured movable in the circumferential direction of the hook ring 45 along the groove 57.

Figure 5A:
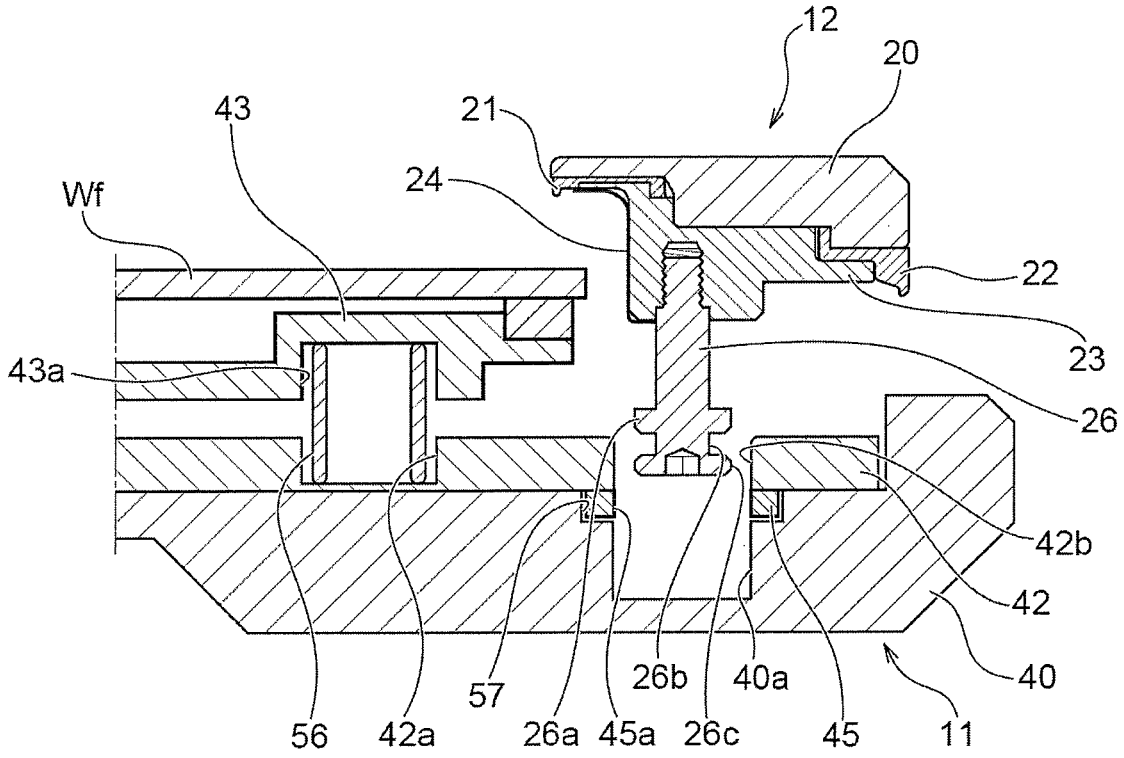
FIG. 5A is a drawing illustrating a state where a first holding member and a second holding member are not fixed to one another.
Figure 5B:
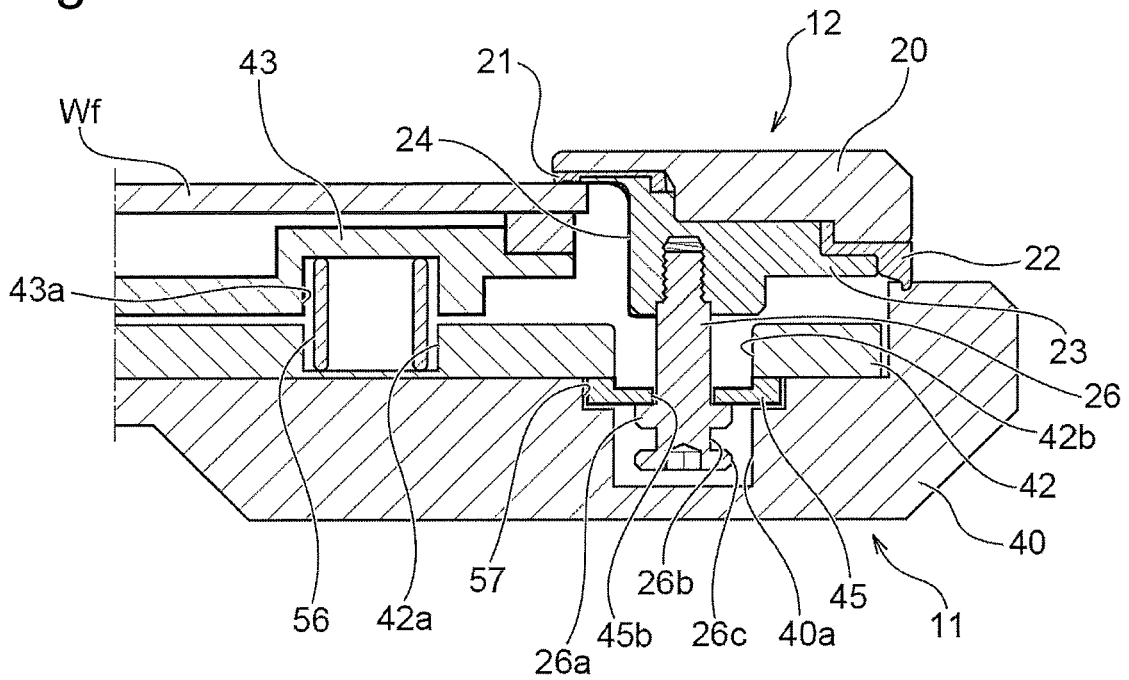
FIG. 5B is a drawing illustrating a lock state where the first holding member and the second holding member are fixed to one another and a substrate-side sealing member and a holder-side sealing member contacts a substrate and a body respectively.
Figure 5C:
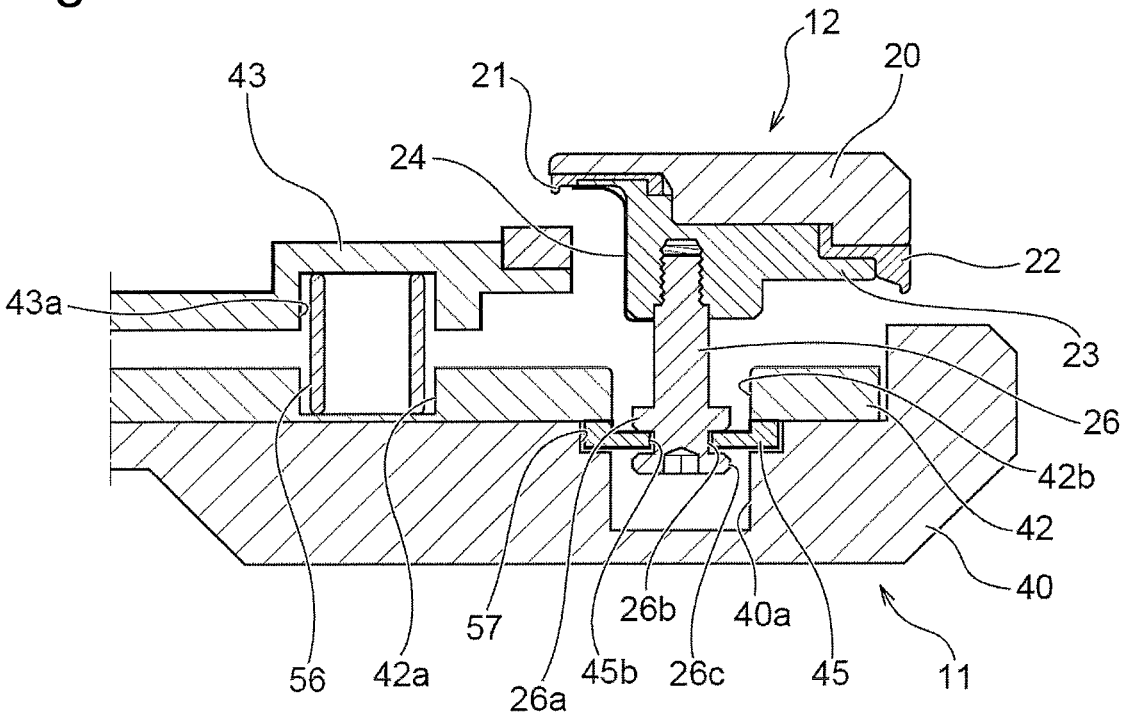
FIG. 5C is a drawing illustrating a semi-lock state where the first holding member and the second holding member are fixed to one another and the substrate-side sealing member and the holder-side sealing member are separated from the first holding member.

The following describes a process to fix the second holding member 12 to the first holding member 11. FIG. 5A to FIG. 5C are enlarged partial cross-sectional side views of the substrate holder 10. Specifically, FIG. 5A is a drawing illustrating a state where the first holding member 11 and the second holding member 12 are not fixed to one another. FIG. 5B is a drawing illustrating a lock state where the first holding member 11 and the second holding member 12 are fixed to one another and the substrate-side sealing member 21 and the holder-side sealing member 22 contact the substrate Wf and the body 40 respectively. FIG. 5C is a drawing illustrating a semi-lock state where the first holding member 11 and the second holding member 12 are fixed to one another and the substrate-side sealing member 21 and the holder-side sealing member 22 are separated from the first holding member 11.

As illustrated in FIG. 5A, the spring 56, which is configured to bias the substrate mounting table 43 toward the second holding member 12, is disposed between the substrate mounting table 43 and the baseplate 42. The spring 56 has one end housed in a depressed portion 42*a* formed on the baseplate 42. The spring 56 has another end housed in a depressed portion 43*a* formed on the substrate mounting table 43. As illustrated in FIG. 5A, when the second holding member 12 is separated from the first holding member 11, the substrate mounting table 43 is biased at a position farthest away from the baseplate 42 by the spring 56.

The second holding member 12 includes the hook pin 26 configured engageable with the hook ring 45. The hook pin 26 is formed of a conductive body such as the SUS to apply the current supplied from the hook ring 45 to the inner ring 23. The hook pin 26 has one end fixed to the inner ring 23. The hook pin 26 has another end on which a lock large-diameter portion 26*a*, a small-diameter portion 26*b*, and a semi-lock large-diameter portion 26*c* are formed. The small-diameter portion 26*b* has a diameter smaller than that of the lock large-diameter portion 26*a*. The semi-lock large-diameter portion 26*c* has a diameter larger than that of the small-diameter portion 26*b*. In the embodiment, the lock large-diameter portion 26*a* and the semi-lock large-diameter portion 26*c* have approximately identical diameters. As illustrated in the drawing, the small-diameter portion 26*b* is positioned between the lock large-diameter portion 26*a* and the semi-lock large-diameter portion 26*c*. The lock large-diameter portion 26*a* is positioned on a side of the inner ring 23 with respect to the semi-lock large-diameter portion 26*c*.

The baseplate 42 of the first holding member 11 has an opening portion 42*b* through which the hook pin 26 is passable. The body 40 has a depressed portion 40*a* through which the lock large-diameter portion 26*a*, the small-diameter portion 26*b*, and the semi-lock large-diameter portion 26*c* of the hook pin 26 are passable. As illustrated in FIG. 5A, the hook ring 45 has a through-hole 45*a* through which the lock large-diameter portion 26*a*, the small-diameter portion 26*b*, and the semi-lock large-diameter portion 26*c* of the hook pin 26 are passable.

When the substrate holder 10 holds the substrate Wf, the substrate attaching and removing portion 120 illustrated in FIG. 1 presses the second holding member 12 to the first holding member 11. At this time, the lock large-diameter portion 26*a*, the small-diameter portion 26*b*, and the semi-lock large-diameter portion 26*c* of the hook pin 26 pass through the opening portion 42*b* and the through-hole 45*a* of the hook ring 45 to be positioned in the depressed portion 40*a* of the body 40. As illustrated in FIG. 5B, the substrate-side sealing member 21 is brought into pressure contact with the surface of the substrate Wf, and the holder-side sealing member 22 is brought into pressure contact with the body 40. The substrate-side sealing member 21 is pressed to the surface of the substrate Wf to contract the spring 56 of the substrate mounting table 43 as illustrated in FIG. 5B. This allows the substrate-side sealing member 21 to appropriately seal the surface of the substrate Wf even if a thickness of the substrate Wf is various.

Figure 6A:
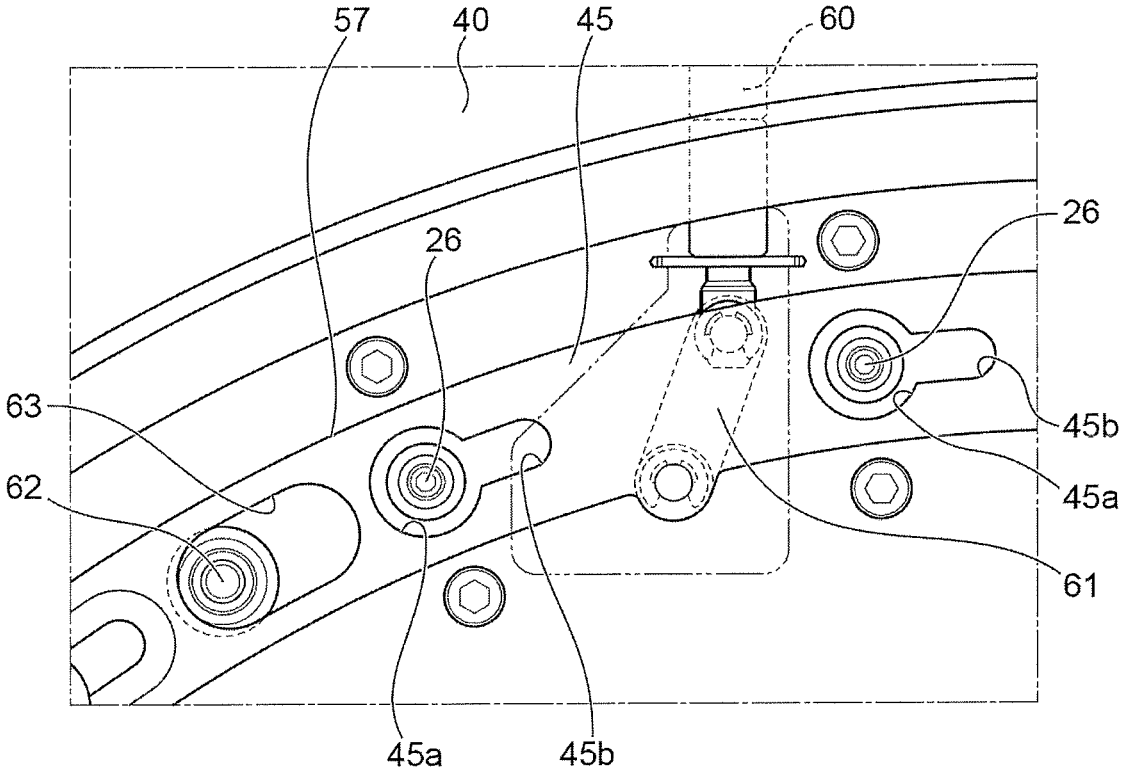
FIG. 6A is a plan view illustrating a position of a hook ring in a state where the hook ring is not engaged with a hook pin.
Figure 6B:
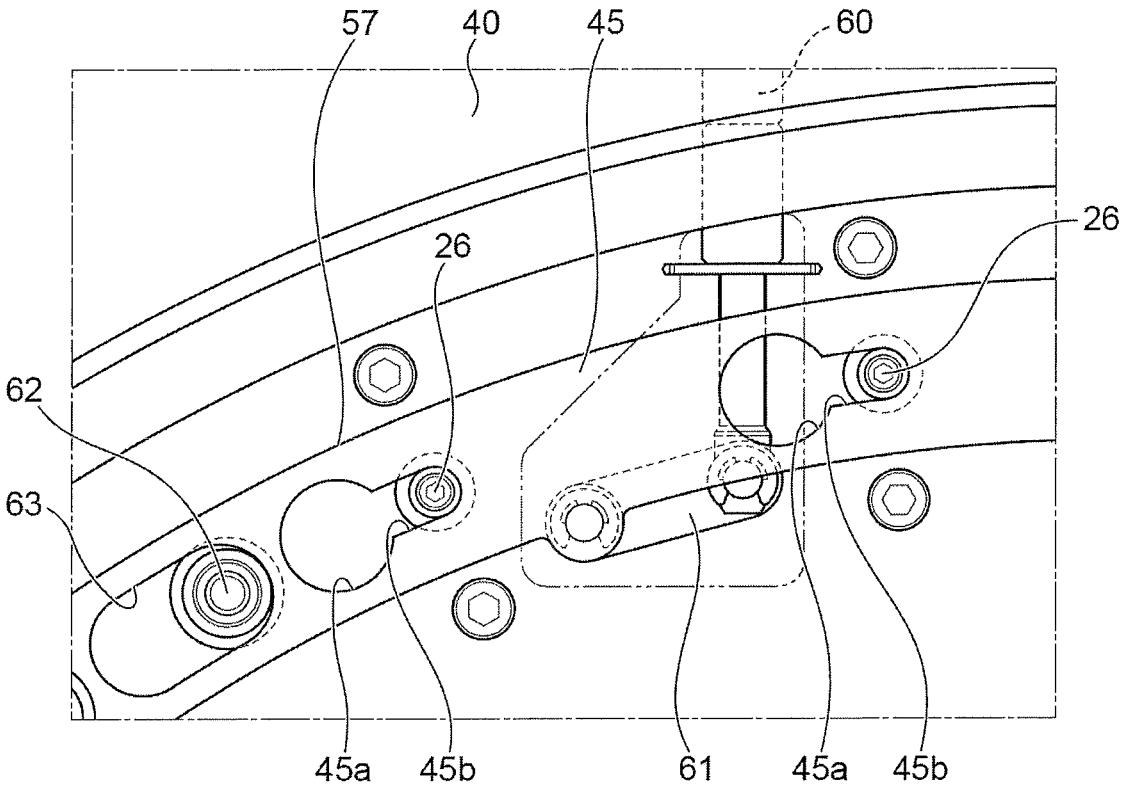
FIG. 6B is a plan view illustrating a position of the hook ring in a state where the hook ring is engaged with the hook pin.

As illustrated in FIG. 5B, the hook ring 45 has a through-hole 45*b* through which the lock large-diameter portion 26*a* of the hook pin 26 is unpassable. The through-hole 45*a* and the through-hole 45*b* are formed communicate and continuous with one another as illustrated in FIG. 6A and FIG. 6B which are described below. The substrate attaching and removing portion 120 illustrated in FIG. 1 moves the hook ring 45 in the circumferential direction in a state where the lock large-diameter portion 26*a* has passed through the through-hole 45*a* of the hook ring 45, that is, a state where the substrate-side sealing member 21 and the holder-side sealing member 22 are brought into pressure contact with the first holding member 11.

Thus, as illustrated in FIG. 5B, the lock large-diameter portion 26*a* of the hook pin 26 is engaged with the through-hole 45*b* of the hook ring 45 to cause the lock large-diameter portion 26*a* not to exit from the through-hole 45*b* of the hook ring 45. Thus, the substrate holder 10 can hold the substrate Wf by bring the substrate-side sealing member 21 and the holder-side sealing member 22 into press-contact with the substrate Wf and the body 40 respectively. In the embodiment, as illustrated in FIG. 5B, the state where the substrate-side sealing member 21 contacts the substrate Wf, the holder-side sealing member 22 contacts the first holding member 11, and the first holding member 11 and the second holding member 12 are fixed to one another is referred to as the lock state.

A description will be given of a current path in the lock state illustrated in FIG. 5B. The current flows from a power source (not illustrated) to the baseplate 42 via the busbar 41 (see FIG. 3) connected to the outer contact portion 18. In the lock state illustrated in FIG. 5B, the hook ring 45 and the hook pin 26 are in contact with one another. Thus, the current flows to the contact 24 in contact with the substrate Wf through the baseplate 42, the hook ring 45, the hook pin 26, and the inner ring 23.

As illustrated in FIG. 5B, the hook pin 26 and the hook ring 45 are positioned in the internal space of the substrate holder 10. This causes the hook pin 26 and the hook ring 45 not to contact the plating solution even when the substrate holder 10 is immersed in the plating solution. Accordingly, a mechanism for fixing the first holding member 11 and the second holding member 12 to one another does not take out the plating solution from the plating bath, thus ensuring reduction in an amount of the plating solution attached to the substrate holder 10.

Incidentally, after the end of the plating process, the substrate Wf is removed from the substrate holder 10 in the substrate attaching and removing portion 120, and then, the substrate holder 10 is temporarily placed in the stocker 124. At this time, when the holder-side sealing member 22 remains in contact with the body 40 of the first holding member 11, it may be a cause of deformation or deterioration of the holder-side sealing member 22. Also when the substrate-side sealing member 21 is temporarily placed in the stocker 124 while remaining in contact with the substrate mounting table 43, similarly, the substrate-side sealing member 21 may deform or deteriorate. Therefore, the substrate holder 10 in the embodiment can mount the second holding member 12 on the first holding member 11 in a state where the substrate-side sealing member 21 and the holder-side sealing member 22 do not contact the first holding member 11. In the embodiment, as illustrated in FIG. 5C, a state where the substrate-side sealing member 21 and the holder-side sealing member 22 do not contact the first holding member 11 and the first holding member 11 and the second holding member 12 are fixed to one another is referred to as the semi-lock state.

When the substrate holder 10 is put into the semi-lock state, the substrate attaching and removing portion 120 illustrated in FIG. 1 causes only the semi-lock large-diameter portion 26*c* of the hook pin 26 to pass through the through-hole 45*a* of the hook ring 45 to be positioned in the depressed portion 40*a* of the body 40. A length of the hook pin 26 is designed so that the substrate-side sealing member 21 and the holder-side sealing member 22 do not contact the first holding member 11 at this time. Subsequently, the substrate attaching and removing portion 120 illustrated in FIG. 1 moves the hook ring 45 in the circumferential direction in a state where only the semi-lock large-diameter portion 26*c* has passed through the through-hole 45*a* of the hook ring 45. Thus, as illustrated in FIG. 5C, the hook ring 45 gets into between the semi-lock large-diameter portion 26*c* and the lock large-diameter portion 26*a*. As a result, the semi-lock large-diameter portion 26*c* is engaged with the through-hole 45*b* of the hook ring 45 to cause the semi-lock large-diameter portion 26*c* not to exit from the through-hole 45*b* of the hook ring 45. Thus, the substrate holder 10 can fix the first holding member 11 and the second holding member 12 to one another in the state where the substrate-side sealing member 21 and the holder-side sealing member 22 do not contact the first holding member 11.

The following describes a moving mechanism of the hook ring 45. FIG. 6A is a plan view illustrating a position of the hook ring 45 in a state where the hook ring 45 is not engaged with the hook pin 26. FIG. 6B is a plan view illustrating a position of the hook ring 45 in a state where the hook ring 45 is engaged with the hook pin 26. As illustrated in the drawing, the through-hole 45*a* of the hook ring 45 is approximately circular, the through-hole 45*b* has an elongate slit shape, and the through-hole 45*a* and the through-hole 45*b* communicate with one another to form one through-hole. The shapes of the through-hole 45*a* and the through-hole 45*b* are any. In the embodiment, the hook ring 45 has the through-hole 45*a* and the through-hole 45*b*. However, instead of them, the hook ring 45 may have a cutout that provides a similar function.

The substrate holder 10 includes the rod member 60 extending in the rod inner passage 49 illustrated in FIG. 3 and an intermediate member 61 coupled to the hook ring 45. The rod member 60 has one end positioned outside the substrate holder 10 as illustrated in FIG. 2 and FIG. 3 and another end pivotally joined to one end of the intermediate member 61 as illustrated in FIG. 6A and FIG. 6B. The rod member 60 is configured axially movable. Specifically, the substrate attaching and removing portion 120 illustrated in FIG. 1 can axially move the rod member 60 by operating the rod member 60 positioned outside the substrate holder 10.

The rod member 60 extends from the outside of the substrate holder 10 to the internal space of the substrate holder 10. Accordingly, the rod inner passage 49 illustrated in FIG. 3 communicates the outside with the internal space of the substrate holder 10. Thus, the substrate holder 10 preferably includes a packing that seals between a wall surface that defines the rod inner passage 49 and an outer peripheral surface of the rod member 60. This can avoid the liquid from entering the internal space of the substrate holder 10 through the rod inner passage 49 and further confirm the presence/absence of the leakage on the internal space of the substrate holder 10 as described later.

The intermediate member 61, which is, for example, an elongate plate-shaped member, has one end pivotally joined to the rod member 60 and another end pivotally joined to the hook ring 45. In the embodiment, the rod member 60 is directly coupled to the intermediate member 61 but not limited to this. The rod member 60 may be indirectly coupled to the intermediate member 61 by causing another member to intervene between the rod member 60 and the intermediate member 61. The rod member 60 and the intermediate member 61 constituent a link mechanism for moving the hook ring 45 in the circumferential direction together.

The substrate holder 10 includes a stopper pin 62 fixed to the body 40. The hook ring 45 has a slit 63 along the circumferential direction. As illustrated in the drawing, the stopper pin 62 is inserted into the slit 63.

When the hook pin 26 is engaged with the hook ring 45, first, the hook pin 26 is inserted through the through-hole 45*a* of the hook ring 45 as illustrated in FIG. 6A. Specifically, when the substrate holder 10 is put into the lock state illustrated in FIG. 5B, the lock large-diameter portion 26*a* of the hook pin 26 is passed through the through-hole 45*a*. When the substrate holder 10 is put into the semi-lock state illustrated in FIG. 5C, only the semi-lock large-diameter portion 26*c* of the hook pin 26 is passed through the through-hole 45*a*.

Subsequently, the substrate attaching and removing portion 120 moves the rod member 60 downward from the state illustrated in FIG. 6A. This transforms a movement in the axial direction of the rod member 60 to a movement in the circumferential direction of the hook ring 45 via the intermediate member 61. Specifically, the hook ring 45 is guided by the groove 57 formed on the body 40 to move in the circumferential direction. Thus, as illustrated in FIG. 6B, the hook pin 26 inserted through the through-hole 45*a* is positioned in the through-hole 45*b*. Specifically, the lock large-diameter portion 26*a* or the semi-lock large-diameter portion 26*c* gets not to exit from the through-hole 45*b* of the hook ring 45. As illustrated in FIG. 6B, the stopper pin 62 can contact an end portion of the slit 63 to restrict the further movement in the circumferential direction of the hook ring 45.

Figure 7:
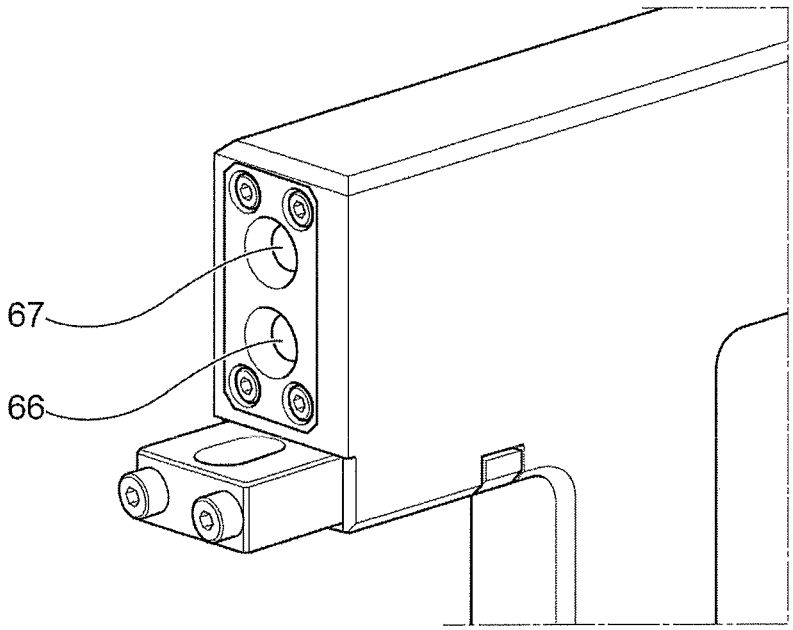
FIG. 7 is an enlarged perspective view of one hand of the substrate holder.

FIG. 7 is an enlarged perspective view of one hand 15 of the substrate holder 10. As illustrated in the drawing, the suction pad 44 illustrated in FIG. 3, a vacuum hole 66, the internal space of the substrate holder 10, and the leakage check hole 67 are formed on a side of the hand 15. The vacuum hole 66 is in fluid communication via the substrate suction vacuum line 51. The leakage check hole 67 is in fluid communication via the leakage check line 50 illustrated in FIG. 3.

A description will be given of a usage of the leakage check hole 67. When the substrate Wf is plated, first, the substrate attaching and removing portion 120 illustrated in FIG. 1 causes the substrate holder 10 to hold the substrate Wf. When the substrate attaching and removing portion 120 mounts the second holding member 12 on the first holding member 11 to make the lock state illustrated in FIG. 5B, the substrate-side sealing member 21 and the holder-side sealing member 22 form the sealed space (the internal space) inside the substrate holder 10. At this time, a nozzle (not illustrated) connected to a vacuum source or a pressurization source is inserted through the leakage check hole 67. Subsequently, the internal space of the substrate holder 10 is evacuated or pressurized via the leakage check hole 67.

Insofar as the substrate-side sealing member 21 and the holder-side sealing member 22 appropriately seal between the first holding member 11 and the second holding member 12, the pressure in the internal space of the substrate holder 10 decreases or increases. Meanwhile, when appropriately sealing between the first holding member 11 and the second holding member 12 is not performed due to, for example, breakage of the substrate-side sealing member 21 and the holder-side sealing member 22, the air flows in the internal space or flows out of the internal space. That is, when what is called the leakage occurs on the internal space of the substrate holder 10, the pressure in the internal space of the substrate holder 10 does not appropriately decrease or increase. In view of this, in the embodiment, when the internal space of the substrate holder 10 is evacuated or pressurized, a pressure gauge (not illustrated) can measure the pressure in the internal space. This pressure gauge can be disposed on a side close to the vacuum source or the pressurization source with respect to the nozzle inserted through the leakage check hole 67 in the substrate attaching and removing portion 120. Instead of the pressure gauge, a flowmeter may measure a micro flow rate. This can check whether there is the leakage on the internal space of the substrate holder 10 or not before plating the substrate Wf.

Figure 8:
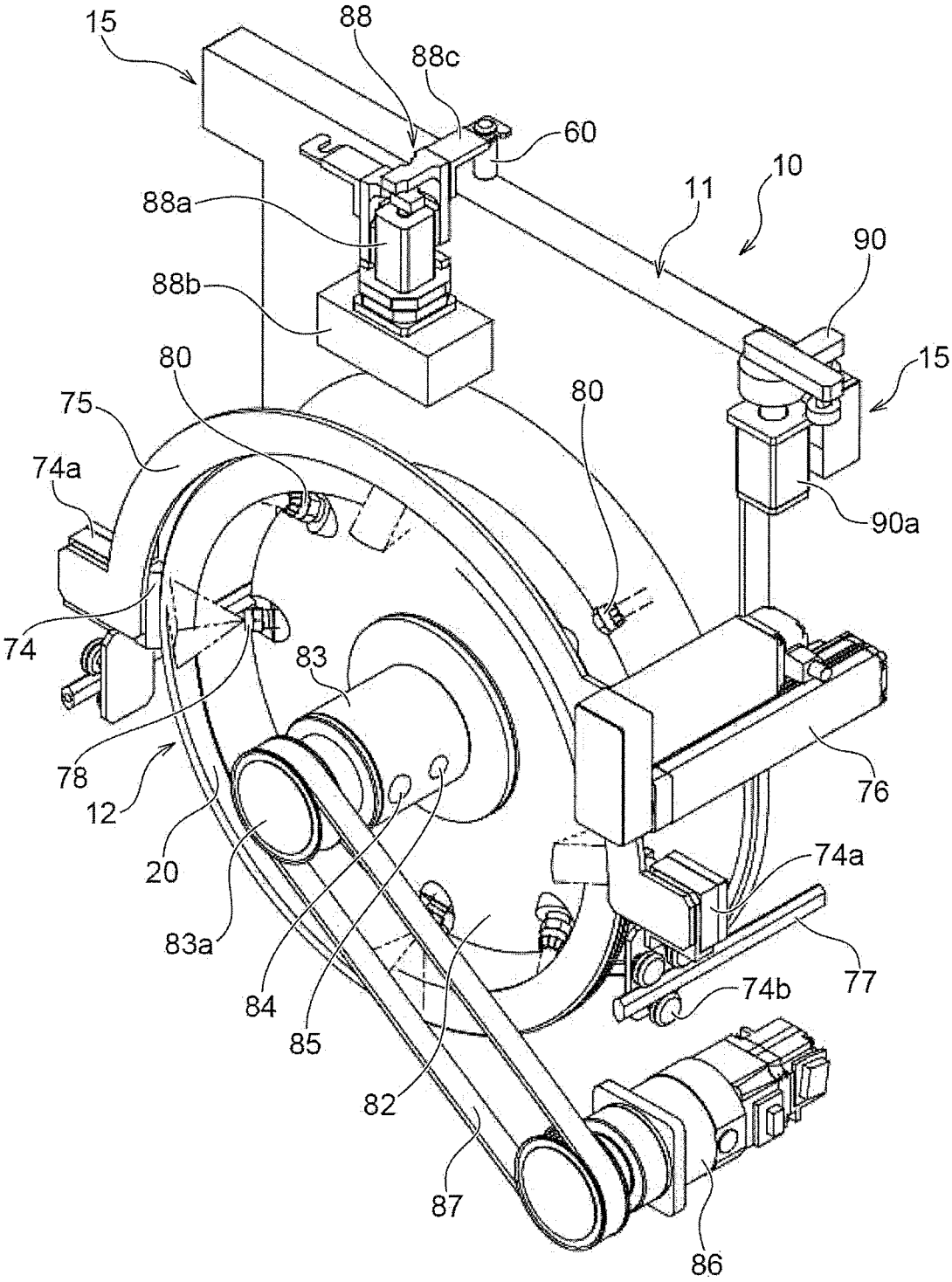
FIG. 8 is a perspective view illustrating a part of a cleaning device.
Figure 9:
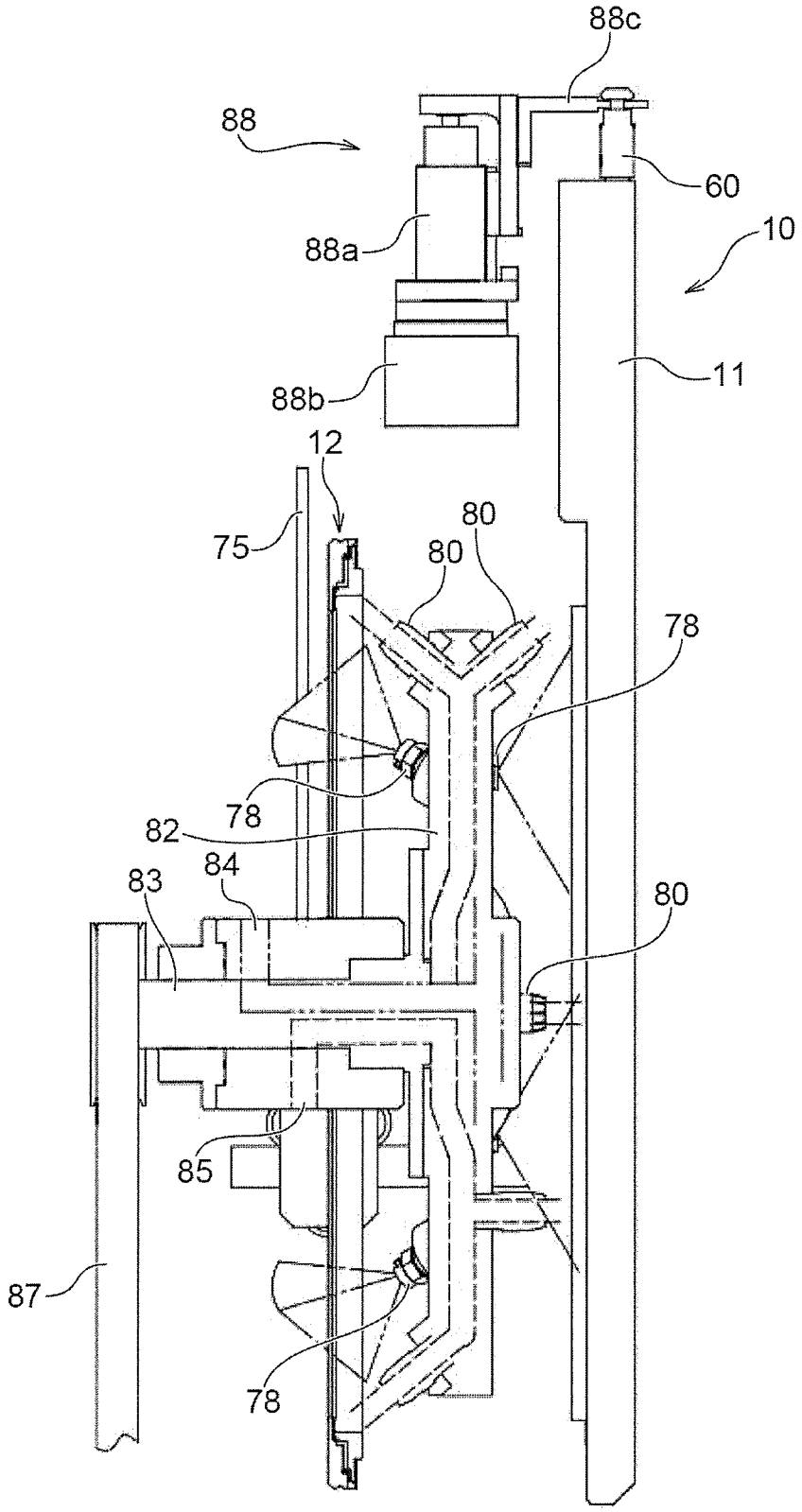
FIG. 9 is a vertical cross-sectional view illustrating a part of the cleaning device.
Figure 10:
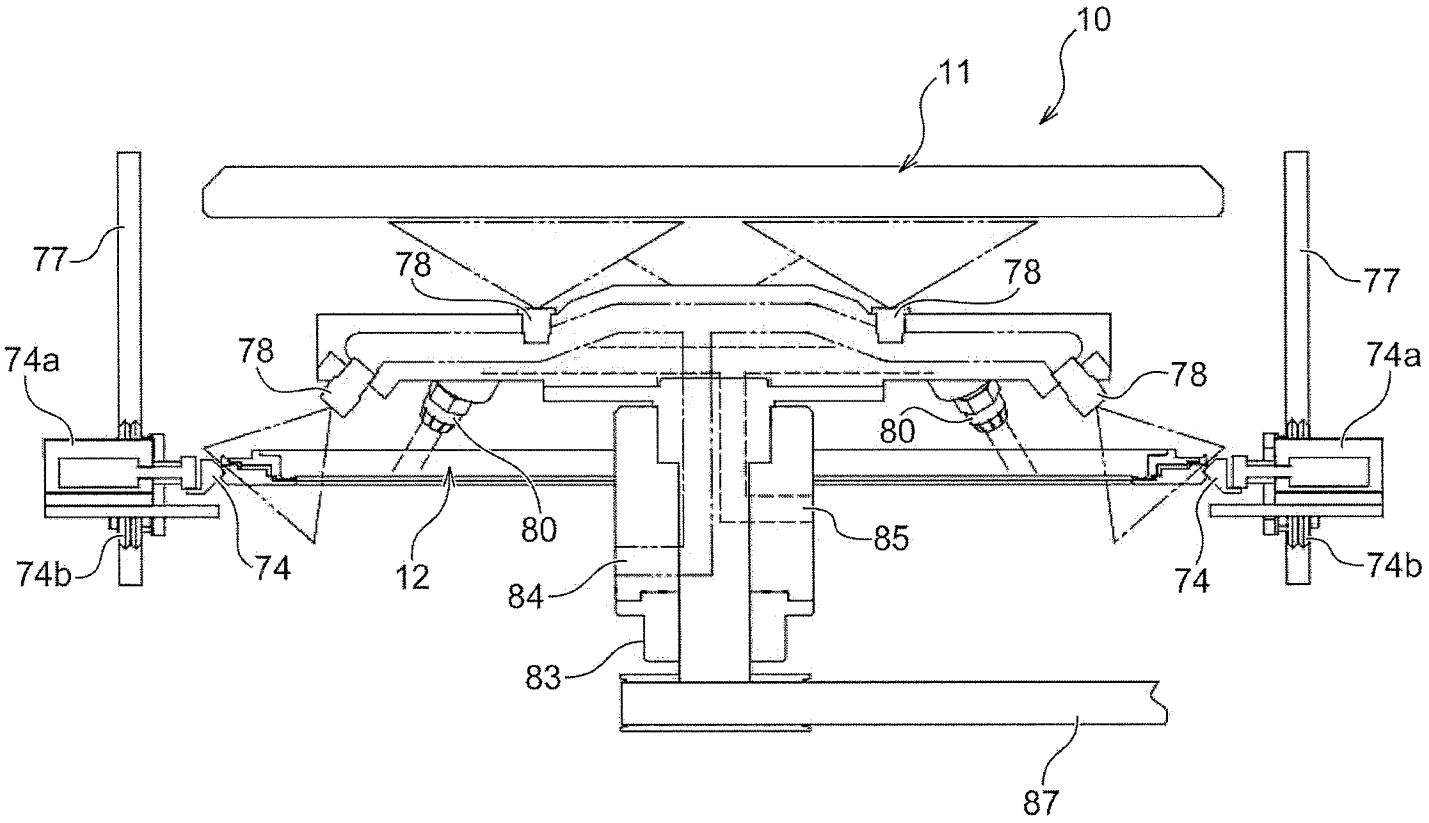
FIG. 10 is a transverse cross-sectional view illustrating a part of the cleaning device.

The following describes a detail configuration of the cleaning device 70 that cleans the substrate holder 10 described above. FIG. 8 is a perspective view illustrating a part of the cleaning device 70. FIG. 9 is a vertical cross-sectional view illustrating a part of the cleaning device 70. FIG. 10 is a transverse cross-sectional view illustrating a part of the cleaning device 70. The cleaning device 70 includes a cleaning bath 72 (see FIG. 12A to FIG. 12D) configured to house the substrate holder 10, but the cleaning bath 72 is omitted in FIG. 8 to FIG. 10. In FIG. 8 to FIG. 10, for convenience of explanation, the substrate holder 10 in a state housed in the cleaning bath 72 is illustrated.

As illustrated in FIG. 8 to FIG. 10, the cleaning device 70 includes clamps 74 (equivalent to an exemplary holding mechanism), a slide actuator 76, cleaning nozzles 78, and drying nozzles 80. The clamp 74 is configured to hold the second holding member 12 of the substrate holder 10. The clamps 74 are driven by a pair of clamp cylinders 74*a* and hold the second holding member 12 by sandwiching side surfaces of the seal ring holder 20 of the second holding member 12. The pair of clamp cylinders 74*a* are connected to one another by a connecting member 75. The slide actuator 76 is configured to move and separate the pair of clamp cylinders 74*a* and the pair of clamps 74 toward/from the first holding member 11 of the substrate holder 10 via the connecting member 75. Specifically, in the embodiment, the clamp cylinder 74*a* includes a slide wheel 74*b*, and the slide actuator 76 moves the clamp 74 in a horizontal direction along a slide rail 77 extending in a thickness direction of the substrate holder 10. Accordingly, the slide actuator 76 can move and separate the second holding member 12 toward/from the first holding member 11 by moving the clamps 74 in a state holding the second holding member 12. As the clamp cylinder 74*a*, for example, an oil pressure type, a water pressure type, an air pressure type, or an electric type cylinder can be employed.

The cleaning device 70 further includes a nozzle plate 82 to which the cleaning nozzles 78 and the drying nozzles 80 are fixed. The nozzle plate 82 forms an approximately disk shape and has an outer diameter smaller than an inner diameter of the second holding member 12, that is, a diameter of the opening 12*a* (see FIG. 2). A plurality of respective cleaning nozzles 78 and drying nozzles 80 are arranged on both surfaces of the nozzle plate 82. The cleaning nozzle 78 (equivalent to an exemplary first cleaning nozzle) and the drying nozzle 80 (equivalent to an exemplary first drying nozzle) which are disposed on a side of the first holding member 11 of the nozzle plate 82 are configured to clean and dry at least a part on which the second holding member 12 is mounted of the first holding member 11. The cleaning nozzle 78 (equivalent to an exemplary second cleaning nozzle) and the drying nozzle 80 (equivalent to an exemplary second drying nozzle) which are disposed on a side opposite to the first holding member 11 of the nozzle plate 82 are configured to clean and dry at least the substrate-side sealing member 21, the holder-side sealing member 22, and the contact 24 of the second holding member 12.

A cleaning liquid inlet portion 84, which supplies the cleaning nozzle 78 with a cleaning liquid such as a DeIonized-Water (DIW), and a gas inlet portion 85, which supplies the drying nozzle 80 with a gas such as nitrogen or air, are connected to the nozzle plate 82. This allows the cleaning nozzle 78 to discharge the cleaning liquid to the substrate holder 10. The drying nozzle 80 can spray the gas to the substrate holder 10. At least one of the cleaning liquid and the drying gas may be discharged or sprayed to the substrate holder 10 at a temperature higher than a normal temperature (a room temperature). This can enhance a cleaning capability or a drying capability in the substrate holder 10.

The nozzle plate 82 has an approximately center portion including a rotation shaft 83 extending in the thickness direction of the substrate holder 10. In the embodiment, the cleaning liquid inlet portion 84 and the gas inlet portion 85 are disposed on the rotation shaft 83. That is, the cleaning liquid and the gas injected to the substrate holder 10 are supplied from the cleaning nozzle 78 and the drying nozzle 80 through supply passages in the rotation shaft 83 and the nozzle plate 82. The rotation shaft 83 has an end portion including a pulley portion 83*a*. The cleaning device 70 further includes a motor 86 and a belt 87. The belt 87 couples the motor 86 to the pulley portion 83*a* of the rotation shaft 83, and rotation of the motor 86 is configured to be transmitted to the pulley portion 83*a*. This drives the motor 86 to configure the nozzle plate 82 to rotate in the circumferential direction. On the other hand, the nozzle plate 82 is configured not to move in the thickness direction of the substrate holder 10 (a right-left direction in FIG. 9 and FIG. 10). However, when it is permissible mechanically or in a restriction on magnitude of the cleaning device 70, the nozzle plate 82 may move in the thickness direction of the substrate holder 10.

When the substrate holder 10 is housed in the cleaning bath 72 (not illustrated) of the cleaning device 70, the hand 15 is placed on an edge of the cleaning bath 72. The cleaning device 70 includes a holder fixing clamp 90 for fixing the hand 15 of the substrate holder 10 housed in the cleaning bath 72 to the cleaning bath 72. The holder fixing clamp 90, which is an approximately rod-shaped member extending in the horizontal direction, is configured to move up and down while being rotated around a vertical axis by a clamp rotating cylinder 90*a*. In a state where the hand 15 of the substrate holder 10 is placed on the edge of the cleaning bath 72, the clamp rotating cylinder 90*a* positions the holder fixing clamp 90 above the hand 15 to press the substrate holder 10 downward. This reduces the movement of the substrate holder 10 at the time of cleaning of the substrate holder 10. As the clamp rotating cylinder 90*a*, for example, an oil pressure type, a water pressure type, an air pressure type, or an electric type cylinder can be employed.

The cleaning device 70 includes a semi-lock/unlock mechanism 88 for adjusting the lock state of the substrate holder 10. The semi-lock/unlock mechanism 88 includes a semi-lock/unlock cylinder 88*a*, a semi-lock/unlock rotating cylinder 88*b*, and an engaging hook 88*c*. The engaging hook 88*c*, which is, for example, an approximately plate-shaped member, is configured engageable with the rod member 60 of the substrate holder 10. The semi-lock/unlock cylinder 88*a* is configured to drive the engaging hook 88*c* in a vertical direction. The semi-lock/unlock rotating cylinder 88*b* is configured to rotate the engaging hook 88*c* around the vertical axis. As the semi-lock/unlock cylinder 88*a* and the semi-lock/unlock rotating cylinder 88*b*, for example, oil pressure type, water pressure type, air pressure type, or electric type cylinders can be employed.

Figure 11:
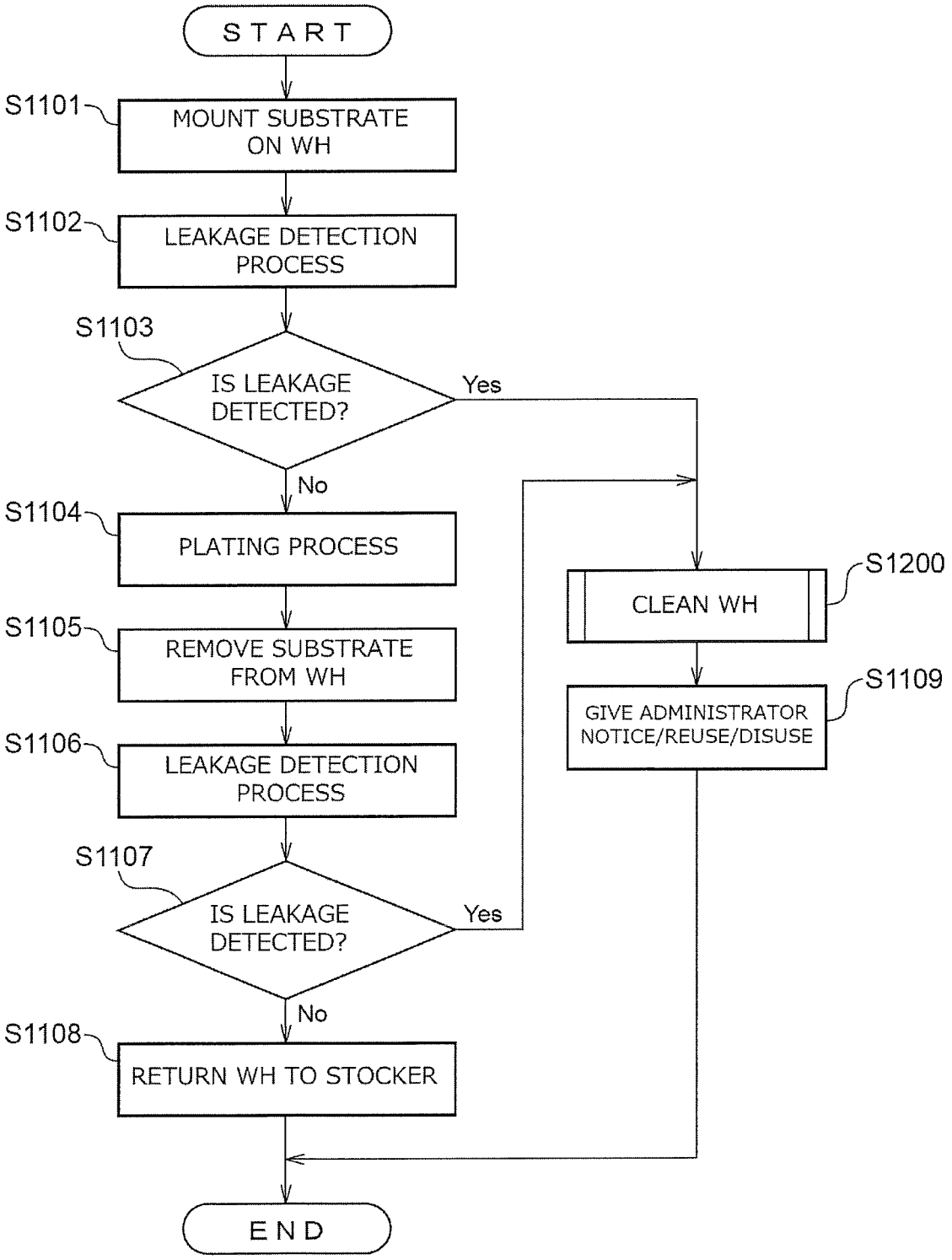
FIG. 11 is a flowchart illustrating a plating process in the plating device according to the embodiment.

The following describes the plating process in the plating device including the above-described cleaning device. FIG. 11 is a flowchart illustrating the plating process in the plating device according to the embodiment. The plating process described below is performed by the control for the respective portions in the plating device by the control unit 145. To start the plating process, first, the substrate conveyance device 122 takes out the substrate Wf from the cassette 100 to convey it to the substrate attaching and removing portion 120. The substrate attaching and removing portion 120 mounts the substrate Wf on the substrate holder 10 (Step S1101).

The substrate attaching and removing portion 120 subsequently inserts the nozzle (not illustrated) connected to the vacuum source or the pressurization source through the leakage check hole 67 illustrated in FIG. 7 to evacuate or pressurize the internal space of the substrate holder 10. The pressure gauge (not illustrated) measures the pressure in the internal space. That is, in the substrate attaching and removing portion 120, a leakage detection process for the substrate holder 10 is performed (Step S1102). The control unit 145 receives a measurement value of this pressure gauge to determine whether there is the leakage on the internal space or not (Step S1103).

When the control unit 145 determines that there is no leakage on the internal space (Step S1103, No), the plating process and the like are performed on the substrate Wf held onto the substrate holder 10 in the respective subsequent processing baths illustrated in FIG. 1 (Step S1104). In the blow bath 132, the substrate holder 10 where the water droplet has been removed is conveyed to the substrate attaching and removing portion 120 again. The substrate attaching and removing portion 120 removes the second holding member 12 from the first holding member 11 to remove the substrate Wf from the substrate holder 10 (Step S1105).

The substrate attaching and removing portion 120 subsequently performs the leakage detection process on the substrate holder 10 (Step S1106). Specifically, the leakage detection process is performed, for example, as follows. That is, the substrate attaching and removing portion 120 obtains an image of at least a part of a surface region of the first holding member 11 and the second holding member 12 which form the internal space of the substrate holder 10 with an image sensor of a camera or the like (not illustrated) in a state where the second holding member 12 has been removed from the first holding member 11. The obtained image is transmitted to the control unit 145. The control unit 145 preliminarily records image data of the above-described surface region to which the liquid is not attached, in the recording medium. The control unit 145 compares the image data of the above-described surface region to which the liquid is not attached with the image data of the above-described surface region obtained by the image sensor to determine whether the liquid is attached or not, that is, whether there is the leakage on the internal space or not (Step S1107).

When the control unit 145 determines that there is no leakage in the substrate holder 10 (Step S1107, No), the control unit 145 controls the substrate holder conveyance device 140 to return the substrate holder 10 to the stocker 124.

In Step S1103 or Step S1107, when the control unit 145 determines that there is the leakage on the internal space of the substrate holder 10 (Step S1103, Yes or Step S1107, Yes), the substrate holder 10 is cleaned (Step S1200). Specifically, the control unit 145 controls the substrate holder conveyance device 140 to convey the substrate holder 10 to the cleaning device 70. When the control unit 145 determines that there is the leakage, the control unit 145 may temporarily convey the substrate holder 10 to the stocker 124. In this case, the control unit 145 confirms whether the cleaning device 70 is empty or not. When the cleaning device 70 is empty, the control unit 145 can control the substrate holder conveyance device 140 to convey the substrate holder 10 to the cleaning device 70.

After the substrate holder 10 is cleaned, the substrate holder 10 is returned to the stocker 124. Afterwards, the control unit 145 may, for example, notify an administrator of a fact that there is the leakage on the internal space of the substrate holder 10 (Step S1109). Specifically, the control unit 145 can give the administrator notice by controlling a notification device (not illustrated) such as a sound device, a vibration device, or a light-emitting device. This allows the administrator to know that there is the leakage in the substrate holder 10 to, for example, replace and maintain the substrate holder 10. The cleaned substrate holder 10 may be used again. That is, the substrate Wf may be mounted on the cleaned substrate holder 10 to perform the plating process on the substrate Wf. Alternatively, it is also possible for the control unit 145 not to use the cleaned substrate holder 10. Specifically, for example, the control unit 145 counts the number of determinations of the presence of the leakage for each substrate holder 10. When this number reaches, for example, twice, this substrate holder 10 can be stored in the stocker 124 so as not to use it.

In the flow illustrated in FIG. 11, the cleaning process for the substrate holder 10 in Step S1200 is performed when the leakage is detected, but it is not limited to this. For example, irrespective of the presence/absence of the leakage, the substrate holder 10 may be periodically (for example, once a day) cleaned in the cleaning device.

The following specifically describes the cleaning process in Step S1200 illustrated in FIG. 11. FIG. 12A to FIG. 12D are schematic cross-sectional side views of the cleaning device 70. In FIG. 12A to FIG. 12D, the cleaning device 70 is simplistically illustrated, and a part of the configuration is omitted. For example, in FIG. 12A to FIG. 12D, the rotation shaft 83 of the nozzle plate 82 is omitted. FIG. 13 is a specific flowchart of the cleaning process in Step S1200. The following describes the cleaning process with reference to FIG. 12A to FIG. 12D and FIG. 13.

Figure 12A:
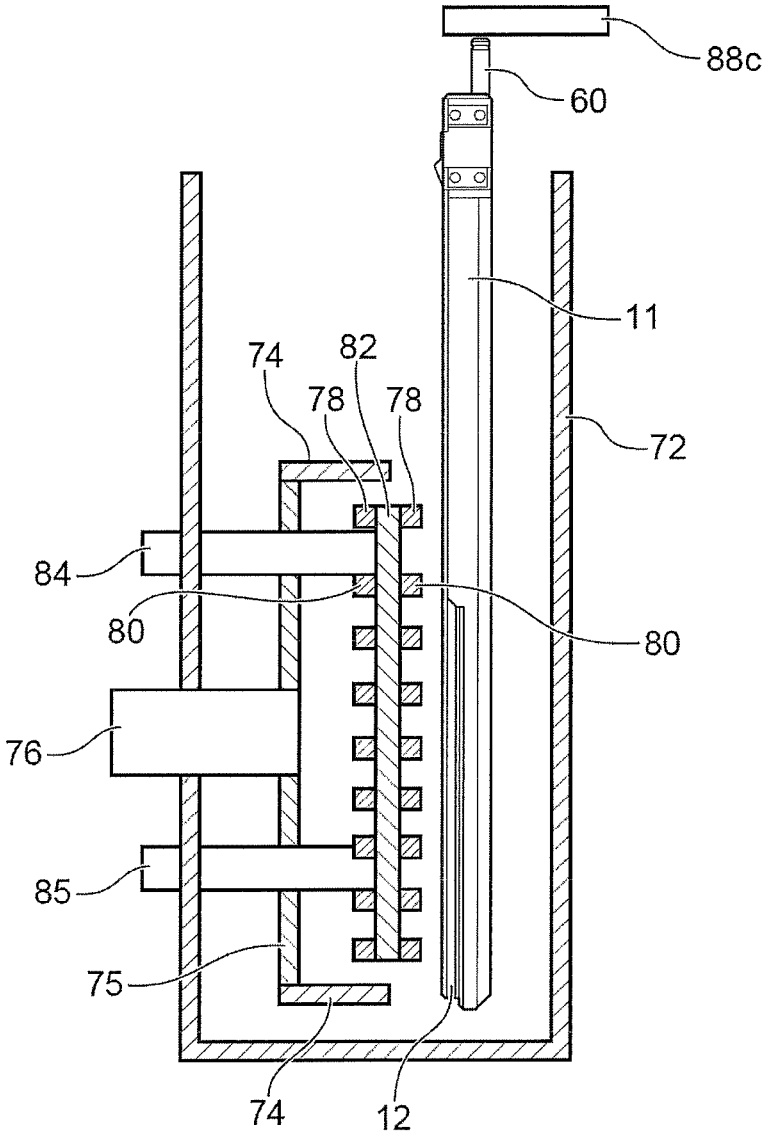
FIG. 12A is a schematic cross-sectional side view of the cleaning device.
Figure 13:
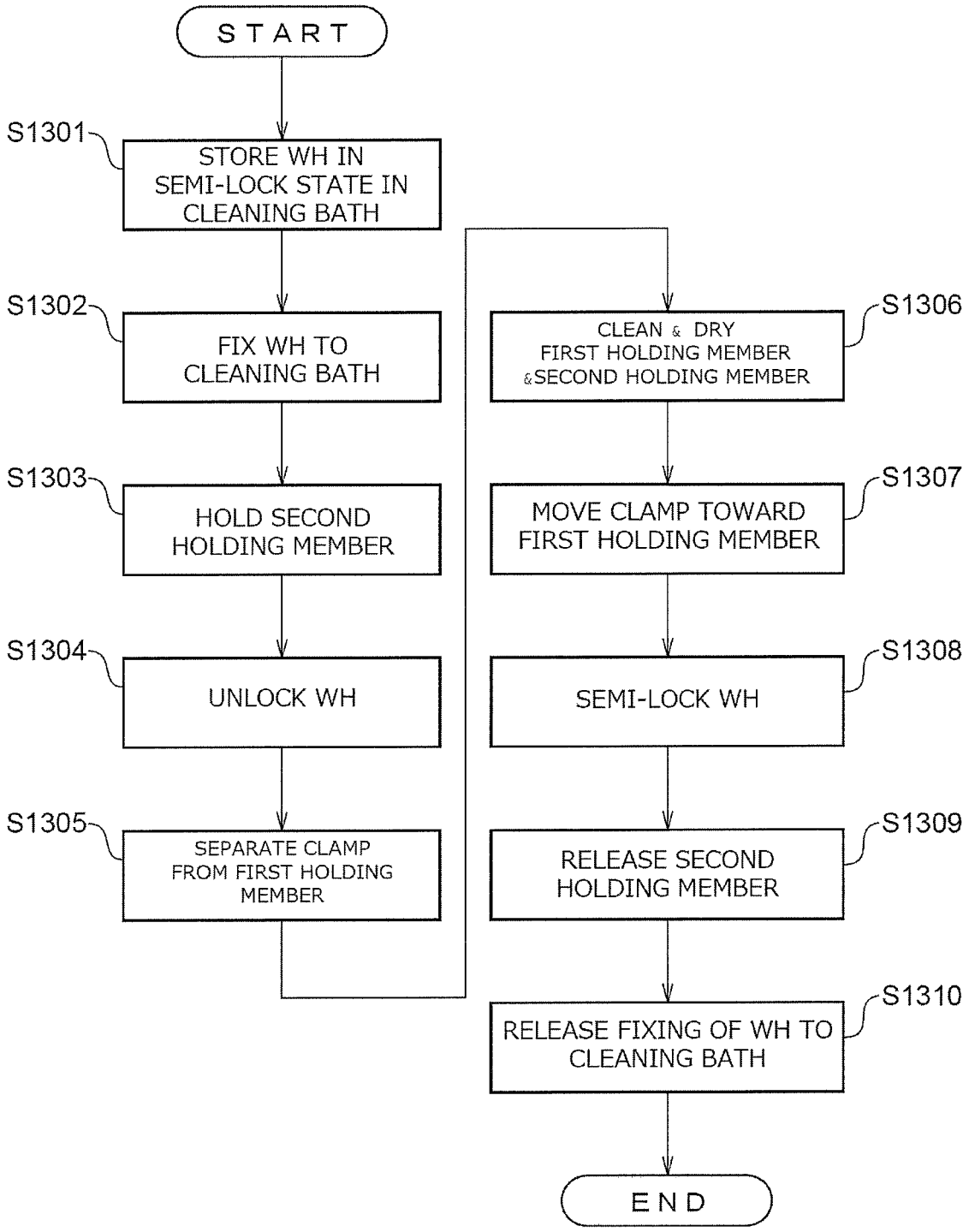
FIG. 13 is a specific flowchart of a cleaning process in Step S1200.

As illustrated in FIG. 12A, first, the substrate holder conveyance device 140 houses the substrate holder 10 in the cleaning bath 72 of the cleaning device 70 (Step S1301). At this time, the substrate holder 10 does not hold the substrate Wf. Thus, the substrate holder 10 is housed in the cleaning bath 72 in the semi-lock state. Subsequently, the control unit 145 controls the clamp rotating cylinder 90*a* illustrated in FIG. 8 to fix the substrate holder 10 to the cleaning bath 72 with the holder fixing clamp 90 (Step S1302).

The control unit 145 controls the clamp cylinder 74*a* to hold the seal ring holder 20 with the clamp 74 (Step S1303). In a state where the seal ring holder 20, that is, the second holding member 12 is held by the clamp 74, the control unit 145 controls the semi-lock/unlock mechanism 88 to operate the rod member 60. Specifically, the control unit 145 controls the semi-lock/unlock rotating cylinder 88*b* to engage the engaging hook 88*c* with the rod member 60. Subsequently, the control unit 145 controls the semi-lock/unlock cylinder 88*a* to drive the engaging hook 88*c* in the vertical direction, thus moving the rod member 60 in the vertical direction. Thus, the hook ring 45 illustrated in, for example, FIG. 6A and FIG. 6B is moved in the circumferential direction along the groove 57 to release the engagement of the hook pin 26 with the hook ring 45. This unlocks the substrate holder 10 (Step S1304).

Subsequently, the control unit 145 controls the slide actuator 76 to separate the clamp 74 holding the seal ring holder 20 from the first holding member 11. At this time, the nozzle plate 82 passes through inside the opening 12*a* of the second holding member 12. In other words, when the second holding member 12 is separated from the first holding member 11, the cleaning nozzle 78 and the drying nozzle 80 which are fixed to the nozzle plate 82 are arranged to pass through the opening 12*a* of the second holding member 12. This positions the nozzle plate 82 between the first holding member 11 and the second holding member 12.

When the nozzle plate 82 can move in the thickness direction of the substrate holder 10 with an actuator or the like (not illustrated), the driving of the slide actuator 76 and the driving of the nozzle plate 82 may be individually performed. That is, for example, after or at the same time as the slide actuator 76 separates the clamp 74 holding the seal ring holder 20 from the first holding member 11, the nozzle plate 82 can be moved in the thickness direction of the substrate holder 10 to cause the nozzle plate 82 to pass through inside the opening 12*a* of the second holding member 12. This arranges the nozzle plate 82 between the first holding member 11 and the second holding member 12.

Figure 12B:
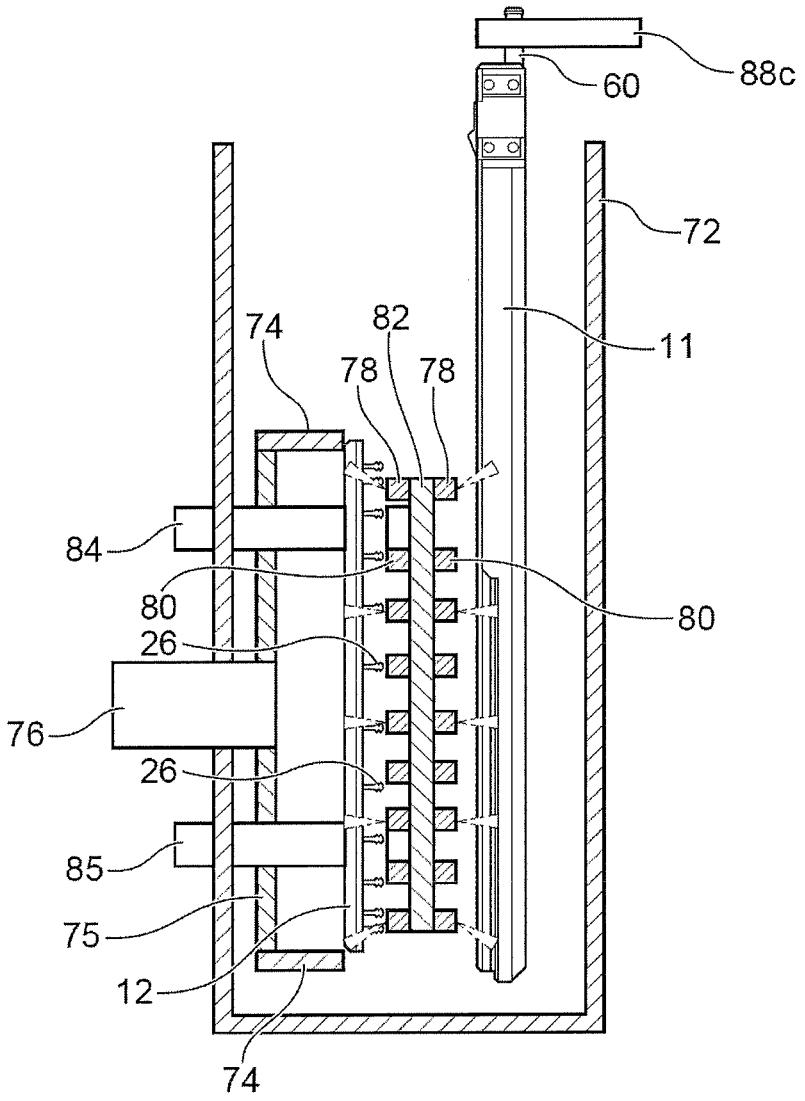
FIG. 12B is a schematic cross-sectional side view of the cleaning device.

Subsequently, the control unit 145 cleans and dries the first holding member 11 and the second holding member 12 (Step S1306). Specifically, as illustrated in FIG. 12B, in a state where the cleaning nozzle 78 and the drying nozzle 80 are arranged between the first holding member 11 and the second holding member 12, the cleaning liquid is discharged from the cleaning nozzle 78 while rotating the nozzle plate 82 in the circumferential direction. This can discharge the cleaning liquid to whole circumferences of the substrate-side sealing member 21, the holder-side sealing member 22, and the contact 24 of the second holding member 12, and the first holding member 11.

Figure 12C:
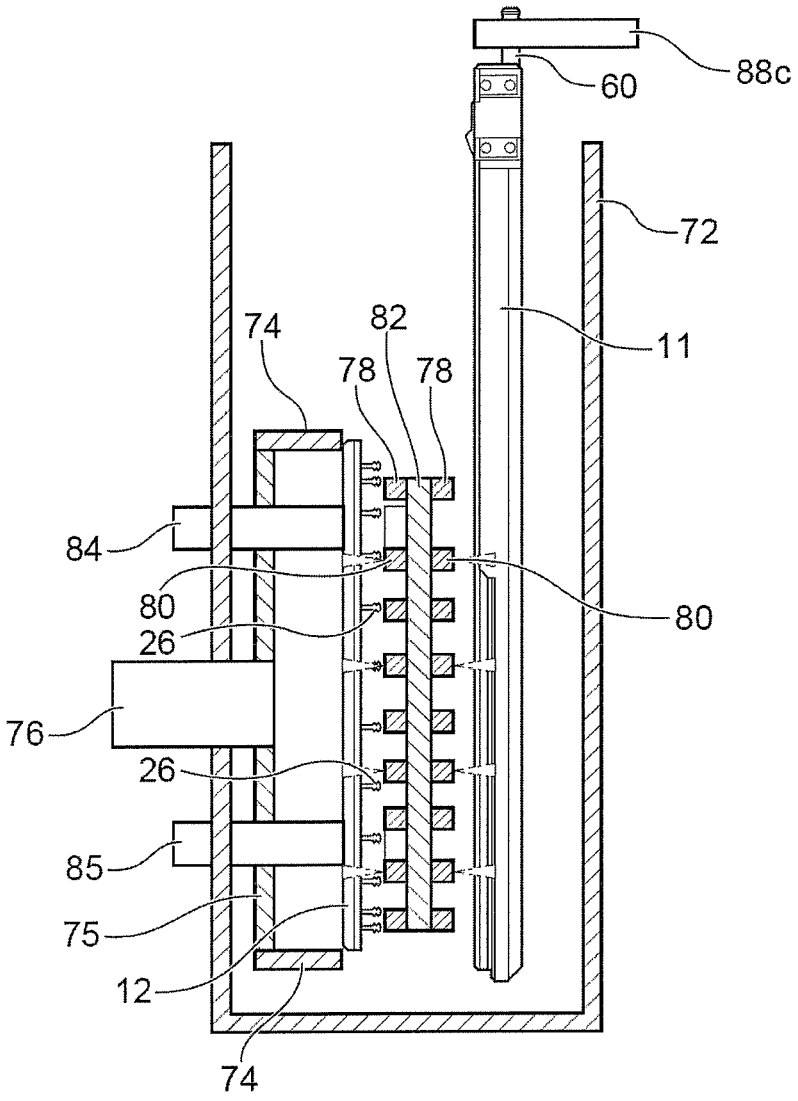
FIG. 12C is a schematic cross-sectional side view of the cleaning device.

After the end of the cleaning by the cleaning nozzle 78, as illustrated in FIG. 12C, in the identical cleaning bath 72, the gas is injected from the drying nozzle 80 while rotating the nozzle plate 82 in the circumferential direction. This can spray the gas to the whole circumferences of the substrate-side sealing member 21, the holder-side sealing member 22, and the contact 24 of the second holding member 12, and the first holding member 11 to dry them.

Figure 12D:
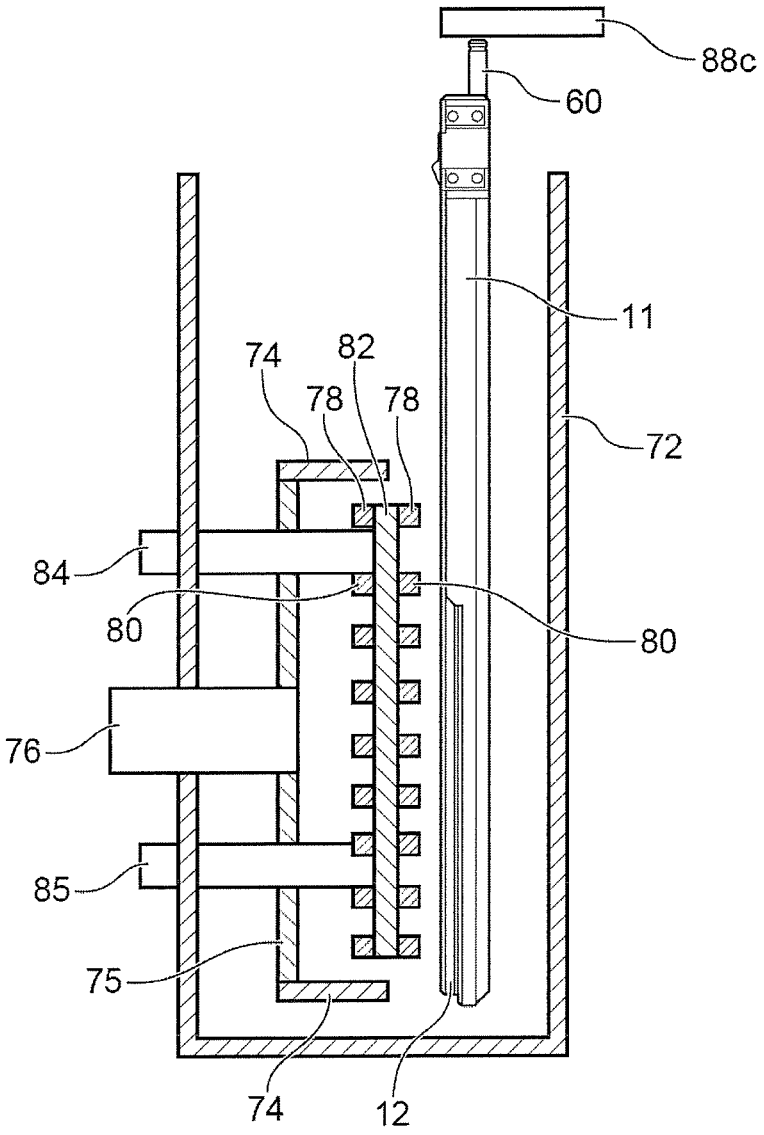
FIG. 12D is a schematic cross-sectional side view of the cleaning device.

After the end of the drying by the drying nozzle 80, the control unit 145 controls the slide actuator 76 to move the clamp 74 holding the second holding member 12 toward the first holding member 11 (Step S1307). At this time, the nozzle plate 82 passes through inside the opening 12*a* of the second holding member 12. Only the semi-lock large-diameter portion 26*c* of the hook pin 26 disposed on the second holding member 12 is inserted through the through-hole 45*a* of the hook ring 45 disposed on the first holding member 11 (see, for example, FIG. 6A). The control unit 145 controls the semi-lock/unlock cylinder 88*a* to drive the engaging hook 88*c* in the vertical direction, thus moving the rod member 60 in the vertical direction. Thus, the hook ring 45 illustrated in, for example, FIG. 6A and FIG. 6B is moved in the circumferential direction along the groove 57 to engage the hook pin 26 with the hook ring 45. This semi-locks the substrate holder 10 as illustrated in FIG. 12D (Step S1308).

When the nozzle plate 82 can move in the thickness direction of the substrate holder 10 with the actuator or the like (not illustrated), the driving of the slide actuator 76 and the driving of the nozzle plate 82 may be individually performed. That is, for example, after or at the same time as the slide actuator 76 moves the clamp 74 holding the seal ring holder 20 toward the first holding member 11, the nozzle plate 82 can be moved in the thickness direction of the substrate holder 10 to cause the nozzle plate 82 to pass through inside the opening 12*a* of the second holding member 12. This arranges the nozzle plate 82 at a position illustrated in FIG. 12D.

Subsequently, the control unit 145 controls the clamp cylinder 74*a* to release the second holding member 12 (Step S1309). At this time, the substrate holder 10 is semi-locked. Thus, even if the second holding member 12 is released, the second holding member 12 does not fall. Last, the control unit 145 controls the clamp rotating cylinder 90*a* illustrated in FIG. 8 to release the fixing of the substrate holder 10 to the cleaning bath 72 (Step S1310).

To clean the substrate-side sealing member 21 and the holder-side sealing member 22, and the contact 24 and the like of the second holding member 12 and to clean the first holding member 11, the cleaning nozzle 78 and the drying nozzle 80 are preferably arranged between the first holding member 11 and the second holding member 12. Therefore, it can be also considered to employ a configuration where the cleaning nozzle 78 and the drying nozzle 80 are taken in and out between the first holding member 11 and the second holding member 12 from a side or an up-down direction of the substrate holder 10. However, in this case, a configuration for moving the cleaning nozzle 78 and the drying nozzle 80 and a large space for moving the cleaning nozzle 78 and the drying nozzle 80 are required, thus increasing a cost and a size of the cleaning device 70.

Therefore, according to the embodiment, the cleaning nozzle 78 and the drying nozzle 80 are passed through the opening 12*a* of the second holding member 12. This can reduce the increase in size of the cleaning device 70 compared with the configuration where the cleaning nozzle 78 and the drying nozzle 80 are taken in and out between the first holding member 11 and the second holding member 12 from the side or the up-down direction of the substrate holder 10. In the embodiment, removing the second holding member 12 from the first holding member 11 without moving the cleaning nozzle 78 and the drying nozzle 80 can arrange the cleaning nozzle 78 and the drying nozzle 80 between the first holding member 11 and the second holding member 12. This can eliminate the need for the mechanism for moving the cleaning nozzle 78 and the drying nozzle 80, thus also reducing the increase in size and cost of the cleaning device 70 due to this mechanism.

According to the embodiment, the nozzle plate 82 includes the cleaning nozzle 78 that discharges the cleaning liquid to the first holding member 11 and the cleaning nozzle 78 that discharges the cleaning liquid to the second holding member 12. As a result, the first holding member 11 and the second holding member 12 can be simultaneously cleaned. Thus, a cleaning efficiency is excellent.

According to the embodiment, the cleaning device 70 includes the drying nozzle 80 for spraying the gas to the substrate holder 10 housed in the cleaning bath 72. Thus, the cleaning and the drying of the substrate holder 10 can be performed in the identical cleaning bath 72. Accordingly, compared with a case where a bath that performs only the cleaning and a bath that performs only the drying are provided, a footprint of the device can be decreased. When the cleaning bath and the drying bath are provided, a period for moving the substrate holder 10 from the cleaning bath to the drying bath is necessary, thus being inefficient. In contrast, in the embodiment, the cleaning and the drying of the substrate holder 10 can be performed in the identical cleaning bath 72, thus eliminating the need for moving the substrate holder 10.

According to the embodiment, the nozzle plate 82 includes the drying nozzle 80 that sprays the gas to the first holding member 11 and the drying nozzle 80 that sprays the gas to the second holding member 12. As a result, the first holding member 11 and the second holding member 12 can be simultaneously dried. Thus, a drying efficiency is excellent.

According to the embodiment, the nozzle plate 82 to which the cleaning nozzle 78 and the drying nozzle 80 are fixed and the motor 86 that rotates the nozzle plate 82 are provided. This can rotate the cleaning nozzle 78 and the drying nozzle 80 to clean and dry the substrate holder 10 in a wide range.

In the above-described embodiment, the first holding member 11 and the second holding member 12 are configured to separate from one another, but the structure of the substrate holder 10 is not limited to this. For example, the second holding member 12 may be coupled to the first holding member 11 via a hinge.

Figure 14:
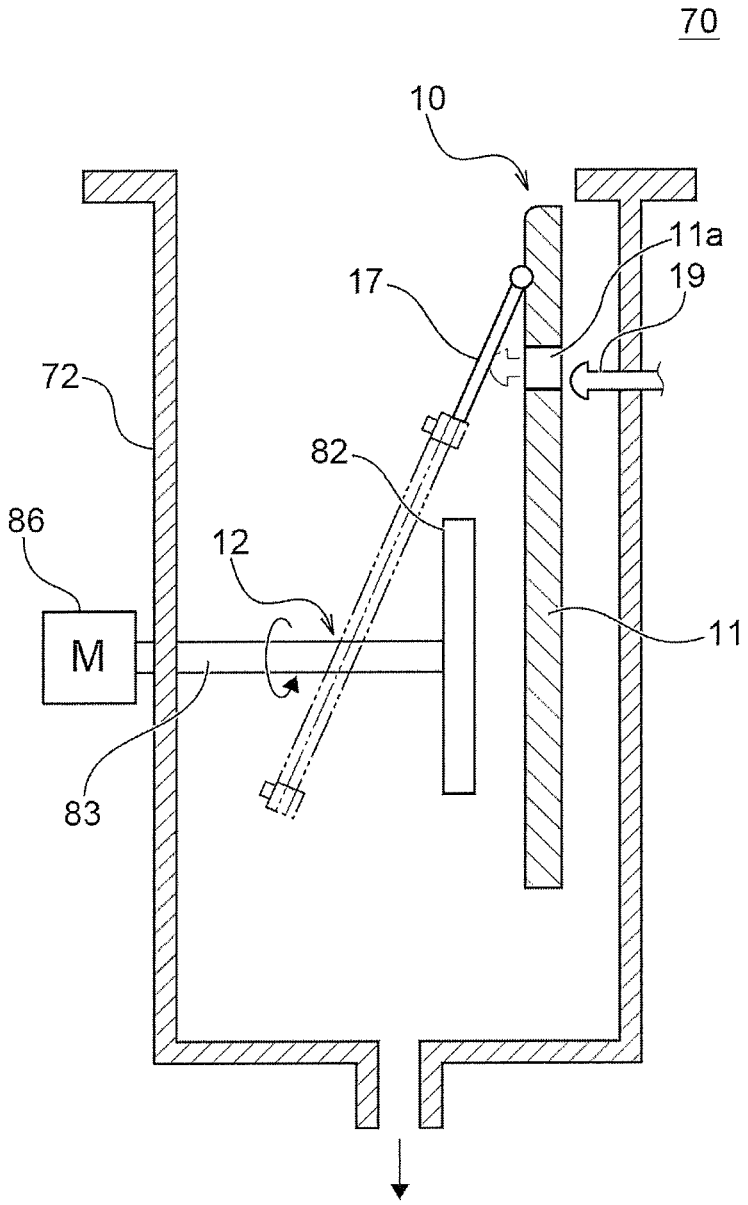
FIG. 14 is a schematic cross-sectional side view illustrating a substrate holder according to another embodiment.

FIG. 14 is a schematic cross-sectional side view illustrating a substrate holder 10 according to another embodiment. As illustrated in the drawing, the substrate holder 10 includes the first holding member 11, the second holding member 12, and a hinge portion 17. The hinge portion 17 is configured to couple the second holding member 12 to the first holding member 11. The first holding member 11 of the substrate holder 10 has a through-hole 11*a* through which an extruding bar 19, which separates the second holding member 12 from the first holding member 11, passes.

As illustrated in the drawing, when the second holding member 12 is separated from the first holding member 11, the extruding bar 19 is inserted through the through-hole 11*a* from a back surface side of the first holding member 11. This brings the extruding bar 19 into contact with the hinge portion 17 to move the second holding member 12 as pushing it upward. At this time, the nozzle plate 82 passes through inside the opening 12*a* of the second holding member 12 to arrange the cleaning nozzle 78 and the drying nozzle 80 (not illustrated), which are fixed to the nozzle plate 82, between the first holding member 11 and the second holding member 12.

According to the embodiment, the cleaning nozzle 78 and the drying nozzle 80 are separately provided, but the cleaning liquid and the drying gas may be supplied from a common nozzle. For example, a path communicated from the cleaning liquid inlet portion 84 to the nozzle and a path communicated from the gas inlet portion 85 to the nozzle may be joined together in its course. Sharing the nozzle for cleaning and the nozzle for drying can arrange many nozzles compared with a case where the nozzle for cleaning and the nozzle for drying are separately provided. Thus, the cleaning and the drying of the substrate can be more effectively performed.

In the embodiment, the cleaning device 70 where the substrate-side sealing member 21, the holder-side sealing member 22, and the contact 24 are cleanable has been described, but a cleaned position of the substrate holder 10 is not specifically limited. For example, the cleaning device 70 in the embodiment is also applicable to cleaning of a seal of an electroless plating substrate holder requiring no contact 24. Similarly, the cleaning device 70 in the embodiment is also applicable to cleaning of a substrate holder holding a substrate for etching, cleaning, or the like of the substrate.

The cleaning device 70 in the embodiment is also applicable to cleaning of a substrate holder having two openings for exposing front and back both surfaces of a substrate. A shape of the substrate to which the cleaning device 70 in the embodiment is applicable is not limited to the circular shape. For example, a substrate holder that brings a contact into contact with only two opposing sides of a rectangular substrate has been known. In this case, a space between parts of the substrate holder for holding only two sides of the substrate can be the opening in the present invention.

The embodiment of the present invention has been described above in order to facilitate understanding of the present invention without limiting the present invention. The present invention can be changed or improved without departing from the gist thereof, and of course, the equivalents of the present invention are included in the present invention. It is possible to arbitrarily combine or omit respective constituent elements according to claims and description in a range in which at least a part of the above-described problems can be solved, or a range in which at least a part of the effects can be exhibited.

The following describes some aspects disclosed by this description.

According to a first aspect, there is provided a cleaning device that cleans a substrate holder including a first holding member and a second holding member having an opening for exposing a substrate. This cleaning device includes a cleaning bath configured to house the substrate holder, an actuator configured to separate the second holding member from the first holding member, and a cleaning nozzle configured to discharge a cleaning liquid to the substrate holder housed in the cleaning bath. The cleaning nozzle is configured to pass through the opening of the second holding member.

According to a second aspect, in the cleaning device of the first aspect, when the actuator separates the second holding member from the first holding member, the cleaning nozzle passes through the opening of the second holding member to be arranged between the first holding member and the second holding member.

According to a third aspect, the cleaning device of the first aspect or the second aspect includes a holding mechanism configured to hold the second holding member. The actuator is configured to move and separate the holding mechanism holding the second holding member toward/from the first holding member.

According to a fourth aspect, in the cleaning device of any of the first aspect to the third aspect, the cleaning nozzle includes a first cleaning nozzle that discharges a cleaning liquid to the first holding member and a second cleaning nozzle that discharges a cleaning liquid to the second holding member.

According to a fifth aspect, the cleaning device of any of the first aspect to the fourth aspect includes a drying nozzle configured to spray a gas to the substrate holder housed in the cleaning bath.

According to a sixth aspect, in the cleaning device of the fifth aspect, the drying nozzle includes a first drying nozzle that sprays a gas to the first holding member and a second drying nozzle that sprays a gas to the second holding member.

According to a seventh aspect, the cleaning device of any of the first aspect to the sixth aspect includes a nozzle plate to which the cleaning nozzle is fixed and a motor configured to rotate the nozzle plate.

According to an eighth aspect, in the cleaning device of the seventh aspect depending on the fifth aspect or the sixth aspect, the drying nozzle is fixed to the nozzle plate.

According to a ninth aspect, a plating device is provided. This plating device includes the cleaning device of any of the first aspect to the eighth aspect and a plating bath configured to house a plating solution.

According to a tenth aspect, the plating device of the ninth aspect includes a conveying device configured to convey the substrate holder, a stocker configured to store the substrate holder, and a control device that controls the conveying device. The control device controls the conveying device to convey the substrate holder cleaned in the cleaning device to the stocker.

According to an eleventh aspect, there is provided a cleaning method for cleaning a substrate holder including a first holding member and a second holding member having an opening for exposing a substrate. This cleaning method includes a step of housing the substrate holder in a cleaning bath, a step of separating the second holding member from the first holding member, a step of passing a cleaning nozzle through the opening, and a step of discharging a cleaning liquid to the substrate holder from the cleaning nozzle in a state where the cleaning nozzle is arranged between the first holding member and the second holding member.

According to a twelfth aspect, in the cleaning method of the eleventh aspect, the passing step of the cleaning nozzle through the opening includes a step of passing the cleaning nozzle through the opening to be arranged between the first holding member and the second holding member when the second holding member is separated from the first holding member.

According to a thirteenth aspect, in the cleaning method of the eleventh aspect or the twelfth aspect, the discharging step of the cleaning liquid includes discharging the cleaning liquid to a contact point and a sealing member of the substrate holder.

According to a fourteenth aspect, the cleaning method of any of the eleventh aspect to the thirteenth aspect includes a step of spraying a gas to the substrate holder to dry the substrate holder.

According to a fifteenth aspect, in the cleaning method of any of the eleventh aspect to the fourteenth aspect, the discharging step of the cleaning liquid includes rotating a nozzle plate to which the cleaning nozzle is fixed.

According to a sixteenth aspect, there is provided a cleaning device that cleans a substrate holder including a first holding member and a second holding member having an opening for exposing a substrate. This cleaning device includes a cleaning bath configured to house the substrate holder, an actuator configured to separate the second holding member from the first holding member, and a cleaning nozzle configured to discharge a cleaning liquid to the substrate holder housed in the cleaning bath. A movement that separates the second holding member from the first holding member by the actuator passes the cleaning nozzle through an opening of the second holding member.

REFERENCE SIGNS LIST

10 . . . substrate holder
11 . . . first holding member
12 . . . second holding member
12*a* . . . opening
21 . . . substrate-side sealing member
22 . . . holder-side sealing member
24 . . . contact
70 . . . cleaning device
72 . . . cleaning bath
74 . . . clamp
76 . . . slide actuator
78 . . . cleaning nozzle
80 . . . drying nozzle
82 . . . nozzle plate
86 . . . motor
124 . . . stocker
145 . . . control unit

What is claimed is:

1. A cleaning device that cleans a substrate holder including a first holding member and a second holding member having an opening for exposing a substrate, the cleaning device comprising:

a cleaning bath configured to house the substrate holder;

an actuator configured to separate the second holding member from the first holding member; and a cleaning nozzle configured to discharge a cleaning liquid to the substrate holder housed in the cleaning bath, wherein the cleaning nozzle is configured to pass through the opening of the second holding member.

2. The cleaning device according to claim 1, wherein when the actuator separates the second holding member from the first holding member, the cleaning nozzle passes through the opening of the second holding member to be arranged between the first holding member and the second holding member.

3. The cleaning device according to claim 1, comprising a holding mechanism configured to hold the second holding member, wherein the actuator is configured to move the holding mechanism holding the second holding member toward the first holding member and to separate the holding mechanism from the first holding member.

4. The cleaning device according to claim 1, wherein the cleaning nozzle includes a first cleaning nozzle that discharges a cleaning liquid to the first holding member and a second cleaning nozzle that discharges a cleaning liquid to the second holding member.

5. The cleaning device according to claim 1, comprising a drying nozzle configured to spray a gas to the substrate holder housed in the cleaning bath.

6. The cleaning device according to claim 5, wherein the drying nozzle includes a first drying nozzle that sprays a gas to the first holding member and a second drying nozzle that sprays a gas to the second holding member.

7. The cleaning device according to claim 1, comprising:

a nozzle plate to which the cleaning nozzle is fixed; and a motor configured to rotate the nozzle plate.

8. The cleaning device according to claim 5, comprising:

a nozzle plate to which the cleaning nozzle is fixed; and a motor configured to rotate the nozzle plate, wherein the drying nozzle is fixed to the nozzle plate.

9. A plating device comprising:

the cleaning device according to claim 1; and a plating bath configured to house a plating solution.

10. The plating device according to claim 9, comprising:

a conveying device configured to convey the substrate holder;

a stocker configured to store the substrate holder; and a control device that controls the conveying device, wherein the control device controls the conveying device to convey the substrate holder cleaned in the cleaning device to the stocker.

11. A cleaning method for cleaning a substrate holder including a first holding member and a second holding member having an opening for exposing a substrate, the cleaning method comprising:

housing the substrate holder in a cleaning bath;

separating the second holding member from the first holding member;

passing a cleaning nozzle through the opening; and discharging a cleaning liquid to the substrate holder from the cleaning nozzle in a state where the cleaning nozzle is arranged between the first holding member and the second holding member.

12. The cleaning method according to claim 11, wherein the passing of the cleaning nozzle through the opening includes passing the cleaning nozzle through the opening to be arranged between the first holding member and the second holding member when the second holding member is separated from the first holding member.

13. The cleaning method according to claim 11, wherein the discharging of the cleaning liquid includes discharging the cleaning liquid to a contact point and a sealing member of the substrate holder.

14. The cleaning method according to claim 11, comprising spraying a gas to the substrate holder to dry the substrate holder.

15. The cleaning method according to claim 11, wherein the discharging of the cleaning liquid includes rotating a nozzle plate to which the cleaning nozzle is fixed.

16. A cleaning device that cleans a substrate holder including a first holding member and a second holding member having an opening for exposing a substrate, the cleaning device comprising:

a cleaning bath configured to house the substrate holder;

an actuator configured to separate the second holding member from the first holding member; and a cleaning nozzle configured to discharge a cleaning liquid to the substrate holder housed in the cleaning bath, wherein the actuator is configured to separate the second holding member from the first holding member passing the cleaning nozzle through the opening of the second holding member.

* * * * *